United States Patent [19]

Tanaka

[11] Patent Number: 5,054,171

[45] Date of Patent: Oct. 8, 1991

[54] BUCKLE DEVICE

[75] Inventor: Kohbun Tanaka, Aichi, Japan

[73] Assignee: Kabushiki Kaisha Tokai-Rika-Denki-Seisakusho, Aichi, Japan

[21] Appl. No.: 535,582

[22] Filed: Jun. 11, 1990

[30] Foreign Application Priority Data

| | | | |
|---|---|---|---|
| Jun. 14, 1989 | [JP] | Japan | 1-69460 |
| Aug. 29, 1989 | [JP] | Japan | 1-222665 |
| Nov. 9, 1989 | [JP] | Japan | 1-291450 |
| Apr. 19, 1990 | [JP] | Japan | 2-103994 |

[51] Int. Cl.[5] ..... A44B 11/25

[52] U.S. Cl. ..... 24/637; 24/633; 24/641

[58] Field of Search ..... 24/637, 638, 641, 643, 24/644, 633

[56] References Cited

U.S. PATENT DOCUMENTS

| | | | |
|---|---|---|---|
| 4,136,425 | 1/1979 | Esner . | |
| 4,196,499 | 4/1980 | Tolfsen . | |
| 4,310,952 | 1/1982 | Robben et al. . | |
| 4,377,888 | 3/1983 | Ikesue | 24/637 |
| 4,404,715 | 9/1983 | Sugimoto | 24/633 |
| 4,575,907 | 3/1986 | Takada | 24/637 |
| 4,587,696 | 5/1986 | Ueda et al. | 24/637 |
| 4,733,444 | 3/1988 | Takada | 24/645 |
| 4,797,984 | 1/1989 | Seto et al. | 24/641 |

FOREIGN PATENT DOCUMENTS

| | | | |
|---|---|---|---|
| 0212507 | 3/1987 | European Pat. Off. . | |
| 0368277 | 5/1990 | European Pat. Off. . | |
| 0384703 | 8/1990 | European Pat. Off. . | |
| 3715207 | 12/1987 | Fed. Rep. of Germany . | |
| 55-42685 | 3/1980 | Japan . | |
| 62-1929 | 1/1982 | Japan . | |
| 2151691 | 7/1985 | United Kingdom | 24/633 |
| 2202896 | 10/1988 | United Kingdom | 24/633 |

*Primary Examiner*—Victor N. Sakran

*Attorney, Agent, or Firm*—Sixbey, Friedman, Leedom & Ferguson

[57] ABSTRACT

A buckle device for use in vehicle seat belt system having a tongue plate and a buckle body into which the tongue plate is inserted for engagement therewith includes a lock member which is swung to engage the inserted tongue plate and is adapted to lock the tongue plate, a release button moved by the operation of a vehicle occupant to swing the lock member in an opposite direction, thereby cancelling engagement between the lock member and the tongue plate, and an emergency lock mechanism for holding the lock member in a state of engagement with the tongue plate when an inertial force acts in an operating direction of the release button. Accordingly, the disengagement between the tongue plate and the lock member due to the inertial force is prevented, and the state of engagement between the two members is maintained.

25 Claims, 26 Drawing Sheets

BUCKLE DEVICE

BACKGROUND OF THE INVENTION

1. Field of the Invention

The present invention relates to a buckle device for use in a vehicle seat belt system and into which a tongue plate is inserted for engagement therewith.

2. Description of the Related Art

Among buckle devices used in seat belt systems, a buckle device having a so-called direct locking mechanism is known in which a lock member is held in a locked state by a release button disposed slidably in the direction of insertion and withdrawal of the tongue plate. The locked state of the tongue plate is canceled by operating the release button by pressing the same.

With this buckle device, however, when inertial force has acts in the direction in which the release button is operated, there is a possibility that the release button moves due to the inertial force, thereby canceling the locked state of the tongue plate. That is, there are two cases where the inertial force acts in the direction in which the release button is operated: (1) those attributable to vehicle vibrations when running on a rough road and (2) those in which a support member for supporting the buckle device on the chassis absorbs energy caused by plastic deformation.

In the latter case, the support member undergoes plastic deformation due to a large load acting on the support member, with the result that the overall buckle device moves suddenly in the direction in which the tongue plate is pulled, and the release button moves in the direction in which it is operated for release, by the inertia of the release button. Specifically in cases where the support member is constituted by material such as a webbing and is secured by being wound around an anchor provided on the chassis, and a portion of the webbing adjacent to the wound portion has been sewn in a folded state, the sewn portion is adapted to be cut off so as to absorb the energy when a large load occurs. In this case, there is a possibility that when the webbing is drawn out suddenly due to the cutting off of the sewn portion upon absorbing the energy, the release button moves in the direction in which it is operated for release, owing to the inertial force.

In addition, among buckle devices used in seat belt systems, one having a so called indirect locking mechanism is known in which the lock member is held in a locking state by means of a lock assisting member such as a pin. When the release button is operated by being pressed, this lock assisting member is adapted to move so as to cancel the locked state of the tongue plate.

With this type of buckle device as well, an inertial force acts in the direction in which the release button is operated, so that when the release button moves due to this inertial force, there is a possibility that the locked state of the tongue plate is canceled.

SUMMARY OF THE INVENTION

Accordingly, an object of the present invention is to provide a buckle device which makes it possible to maintain the locked state of a tongue plate even when an inertial force acts in a lock canceling direction of a lock canceling means, thereby overcoming the above-described drawbacks of the conventional art.

To this end, in accordance with one aspect of the present invention, a buckle device is provided for use in a seat belt system, comprising: a buckle body; a tongue plate inserted into said buckle body; a lock member which is supported by said buckle body, engages said inserted tongue plate and is swingable between a first position for locking said tongue plate and a second position in which engagement between said lock member and said tongue plate is canceled; releasing means supported by said buckle body movably in a predetermined direction and adapted to swing said lock member from said first position to said second position; and emergency lock means for holding a state of engagement between said lock member and said tongue plate when an inertial force has acted in said predetermined direction.

In accordance with another aspect of the present invention, the buckle device includes releasing force transmitting means allowing the lock member and the releasing means to interlock with each other.

In accordance with still another aspect of the present invention, the buckle device includes a lock assisting member disposed movably between a locking position for holding the lock member in an state in which it is engaged with the tongue plate and a releasing position in which the lock member can be disengaged from the tongue plate.

In accordance with the first aspect of the present invention, in the event that an inertial force has acted in a predetermined direction in a state in which the lock member is holding the tongue plate in the locked state, the emergency lock means holds the lock member in a state of engagement with the tongue plate by preventing the lock member from moving from the first position to the second position. Accordingly, it is possible to maintain the locked state of the tongue plate even when an inertial force has acted on the releasing means in a predetermined direction.

Meanwhile, when the occupant operates the releasing means in a predetermined direction, the locking state of the lock member is canceled, so that the tongue plate can be removed.

It suffices if the emergency lock means is adapted to maintain the locked state of the tongue plate when an inertial force has acted in a predetermined direction, so that the emergency lock means may be disposed in any part of the buckle device.

In addition, in accordance with the second aspect of the present invention, in the event that an inertial force has acted in a predetermined direction in a state in which the lock member is holding the tongue plate in the locked state, the emergency lock means holds at least one of the lock member and the releasing force transmitting means in a state of engagement with the tongue plate. Accordingly, it is possible to maintain the locked state of the tongue plate even when the inertial force has acted on the releasing means in the predetermined direction.

Meanwhile, when the occupant operates the releasing means in a predetermined direction, the locking state of the lock member is canceled via the releasing force transmitting means, so that the tongue plate can be removed.

In addition, in accordance with the third aspect of the present invention, in the event that an inertial force has acted in a predetermined direction in a state in which the lock member is held in the locking state by means of the lock assisting member, instead of the lock assisting member, the emergency lock means holds the lock member in the state of engagement with the tongue plate. Accordingly, it is possible to maintain the locked state of the tongue plate even when the inertial force has acted on the releasing means in the predetermined direction.

Meanwhile, when the occupant operates the releasing means in a predetermined direction, the locking state of the lock member is canceled as the lock assisting member moves to the releasing position, so that the tongue plate can be removed.

The above and other objects, features and advantages of the present invention will become more apparent from the following detailed description of the invention when read in conjunction with the accompanying drawings.

DESCRIPTION OF THE PREFERRED EMBODIMENTS

Figure 1:
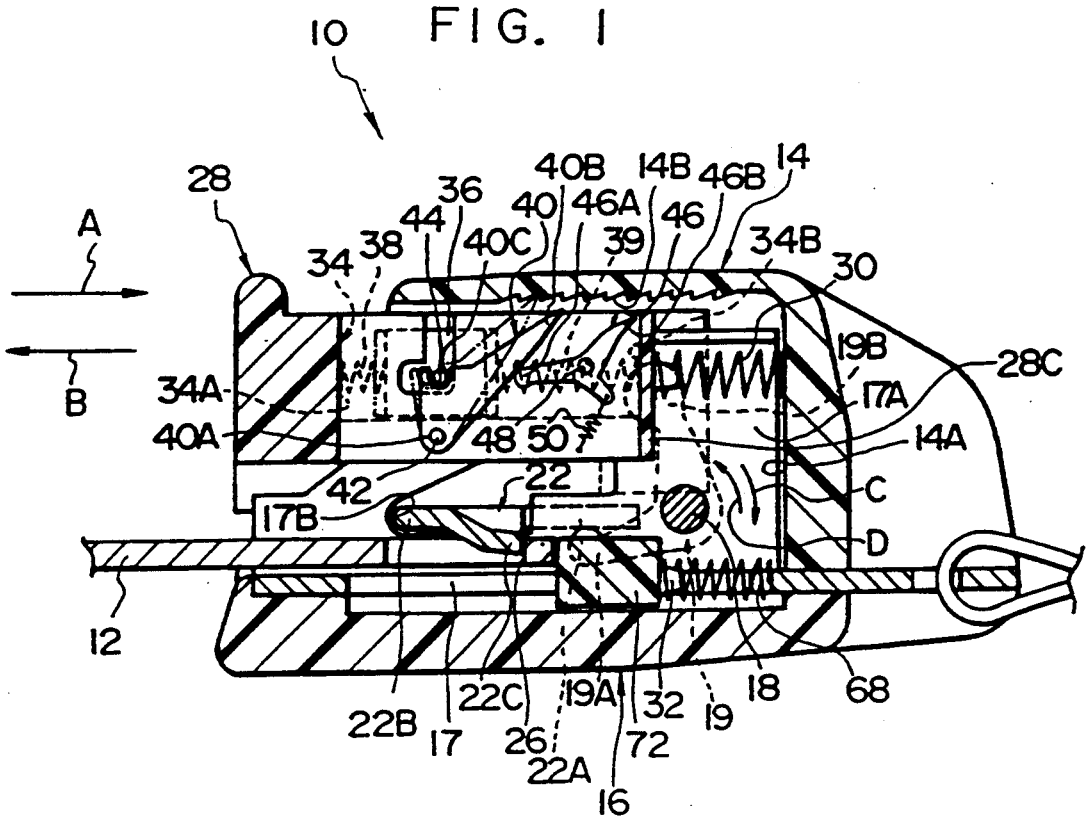
FIG. 1 is a cross-sectional view schematically illustrating a state of engagement of a tongue plate of a buckle device in accordance with a first embodiment of the present invention.
Figure 2:
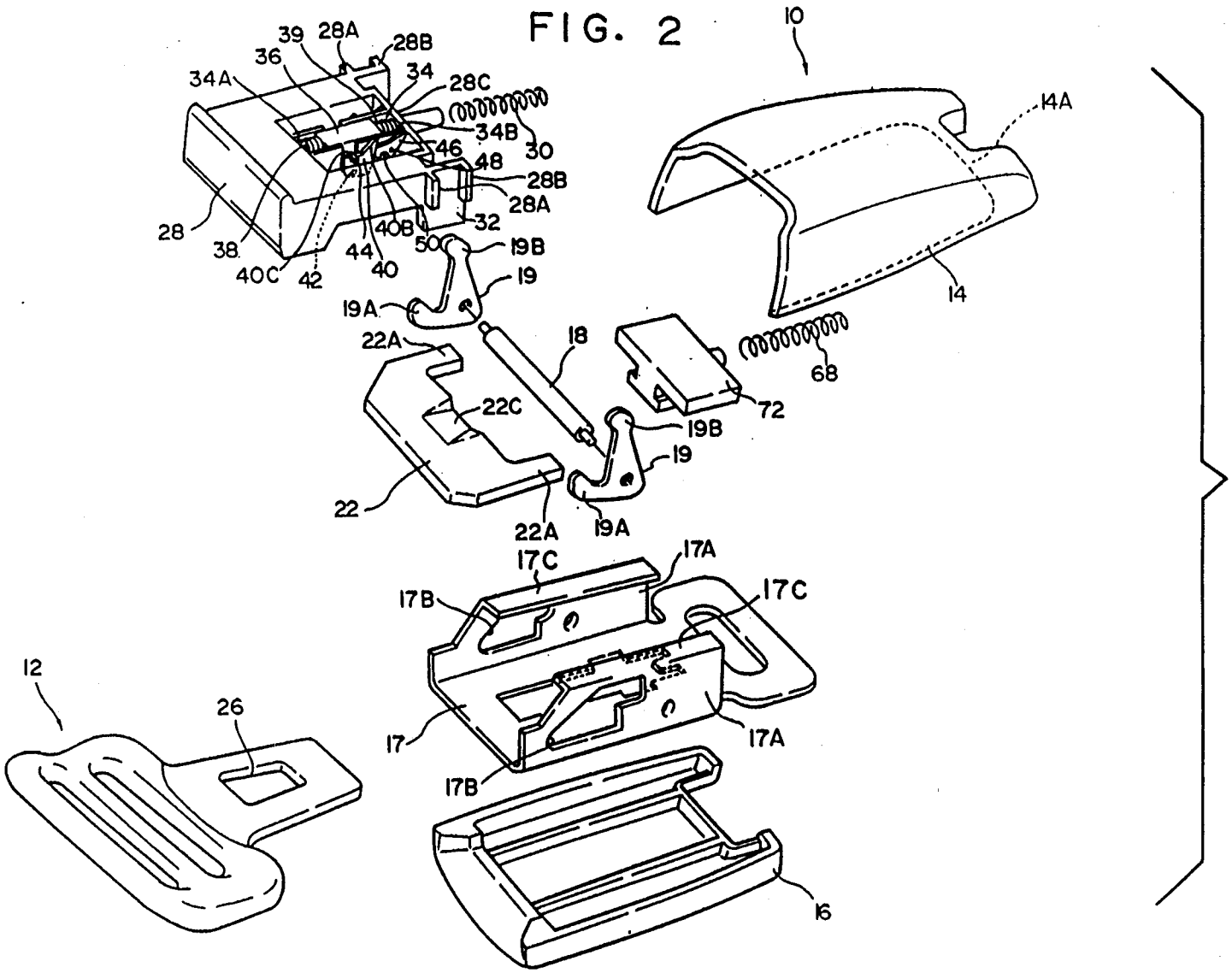
FIG. 2 is an exploded perspective view of the buckle device in accordance with the first embodiment of the present invention.

Referring now to FIGS. 1 and 2, a description will be given of a first embodiment of the present invention.

In a buckle device 10, a buckle body 17 is interposed between an upper cover 14 and a lower cover 16. The buckle body 17 has a pair of side plates 17A integrally formed on transversely opposite sides thereof by being bent toward the upper cover 14 so as to be situated on transversely opposite sides of a tongue plate 12 when the tongue plate 12 is inserted into the buckle body 17 to be locked. A pair of levers 19 serving as a releasing force transmitting means are each journaled on a pin 18 on an outer side of each of the side plates 17A at a substantially central portion thereof, as viewed in the direction of insertion and withdrawal of the tongue plate 12 (in the direction of arrow A or B), in such a manner as to be swingable clockwise in FIG. 1 (in the direction of arrow C in FIG. 1) and counterclockwise in FIG. 1 (in the direction of arrow D in FIG. 1).

Each of these levers 19 is formed into an L-shaped configuration and is rotatably supported at its substantially central portion by the pin 18. A projection projecting toward the upper cover 14 is provided at one end 19A of each of the levers 19. A pair of end portions 22A of a lock plate 22 (serving as a lock member) that are provided in a perpendicular direction (hereinafter referred to as the transverse direction) to the direction of insertion and withdrawal of the tongue plate 12 respectively correspond to these projections from the direction of the upper cover 14. That is, the lock plate 22 is inserted into holes 17B provided in the side plates 17A of the buckle body 17 and are supported by the side plates 17A in such a manner as to be swingable in the direction of arrow C in FIG. 1 and in the direction of arrow D in FIG. 1. Also, the end portions 22A project outwardly from the side plates 17A and are brought into contact with the ends 19A of the levers 19, respectively A hook 22C projects from a surface of a transversely central portion of the lock plate 22 on the lower cover 16 side. This hook 22C engages with an engaging hole 26 in the tongue plate 12.

Accordingly, when the levers 19 swing in the direction of arrow C in FIG. 1 from a state in which the claw 22C of the lock plate 22 is engaged with the engaging hole 26 of the tongue plate 12, the lock plate 22 swing in the direction of arrow D in FIG. 1, thereby causing the hook 22C of the lock plate 22 to be released from the engaging hole 26 of the tongue plate 12.

In addition, a release button 28 serving as a lock canceling means is supported by the buckle body 17 in such a manner as to be movable in the direction of insertion and withdrawal of the tongue plate 12 (i.e., in the direction of arrow A or B in FIG. 1). Specifically, tips of the pair of side plates 17A of the buckle body 17 are formed into bent portions 17C bent in a mutually approaching direction. A pair of guide grooves (not shown) extending from an end of the release button 28, into which the tongue plate 12 is inserted, in the direction of withdrawal of the tongue plate 12 are formed on the rear surface of the release button 28, The guide grooves have a substantially L-shaped configuration corresponding to the bent portions 17C. Accordingly, when the release button 28 is inserted in a pair of guide grooves (not shown) provided in the bent portions 17C, the release button 28 is guided by the two pairs of the guide grooves in such a manner as to be movable in the direction of insertion and withdrawal of the tongue plate 12. In a state in which the release button 28 is supported by the buckle body 17, a projection 28A formed at a right-hand end, as viewed in FIG. 1, of each side surface of the release button 28 is brought into contact with the other end 19B of each of the levers 19 from the right side in FIG. 1. A coil spring 30 is inserted between a right-hand end 28C, as viewed in FIG. 1, of the release button 28 and an inner wall 14A of the upper cover 14. The coil spring 30 is adapted to urge the release button 28 in the direction of arrow B in FIG. 1 (in the direction of withdrawal of the tongue plate 12). Accordingly, when the release button 28 is operated by being pressed in the direction of arrow A in FIG. 1 (in the direction of insertion of the tongue plate 12) against the urging force of the coil spring 30, the levers 19 are swung in the direction of arrow C in FIG. 1 as the ends 19B are pressed by the projections 28A of the release button 28. In addition, a pair of projections 28B are respectively provided on the right-hand sides, as viewed in FIG. 1, of the projections 28A of the release button 28 and in parallel therewith. Accordingly, the levers 19 are held in the position shown by the solid line in FIG. 1 as their ends 19B are pressed by the projections 28B of the release button 28 by means of the urging force of the coil spring 30.

A pair of projections 32 are formed on the lower cover 16 side of the end 28C of the release button 28 at positions corresponding to the end portions 22A. As the projections 32 are brought into contact with the end portions 22A, the lock plate 22 is adapted to swing in the direction of arrow D in FIG. 1 (counterclockwise), thereby preventing the hook 22C of the lock plate 22 from being disengaged from the engaging hole 26 in the tongue plate 12. In addition, when the release button 28 is moved in the direction of arrow A in FIG. 1 (in the direction of insertion of the tongue plate 12), the projections 32 are also moved in the direction of arrow A in FIG. 1, so that the lock plate 22 is swingable in the direction of arrow D in FIG. 1.

A cavity 34 is formed inside the release button 28 along the directions of arrows A, B in FIG. 1 (in the direction of insertion and withdrawal of the tongue plate 21). A block 36 is disposed inside the cavity 34 in such a manner as to be slidable along the cavity 34, i.e., in the direction of insertion and withdrawal of the tongue plate 12. Coil springs 38, 39 are respectively inserted between the block 36 and the left and right side surfaces 34A, 34B, as viewed in FIG. 1, of the cavity 34 so as to hold the block 36 in a substantially central position of the cavity 34. Accordingly, when sudden acceleration acts on either the release button 28 or the block 34 in the direction of arrow A (in the direction of insertion of the tongue plate 12) or in the direction of arrow B (in the direction of withdrawal of the tongue plate 12) in FIG. 1, the block 36 moves inside the cavity 34 relative to the release button 28 in the direction of arrow A or B in FIG. 1.

One end 40A of a pawl 40 serving as a part of an emergency lock means is rotatably supported by a pin 42 on this side surface of the release button 28 as viewed in FIG. 1. The other end 40B of the pawl 40 extends to the vicinity of the upper cover 14 and is disposed such that it is engageable with a serrated engaging portion 14B formed on an inner surface the upper cover 14. In addition, a notch 40C is formed in the pawl 40, and a pin 44 projecting from the block 36 engages the notch 40C. Accordingly, when the block 36 moves with respect to the release button 28 in the direction of arrow B in FIG. 1, the pawl 40 swings in the direction of arrow D in FIG. 1. (counterclockwise in FIG. 1), thereby causing the end 40B of the pawl 40 to engage with the engaging portion 14B.

In addition, one end 46A of a pawl 46 constituting another part of the emergency lock means abuts against the pawl 40. A central portion of the pawl 46 is rotatably supported by the release button via a pin 48 in such a manner as to be swingable in the direction of arrow C or D in FIG. 1. A coil spring 50 having opposite ends respectively engaged with and connected to the pawl 46 and the release button, so that the pawl 46 is constantly urged in the direction of arrow C in FIG. 1 by means of this coil spring 50. When the pawl 46 swings in the direction of arrow D in FIG. 1 against the urging force of the coil spring 50, the other end 46B of the pawl 46 engages with the engaging portion 14B of the upper cover 14.

Accordingly, when the block 36 moves with respect to the release button 28 in the direction of arrow A in FIG. 1, the pawl 40 swings in the direction of arrow C in FIG. 1, while the pawl 46 swings in the direction of arrow D in FIG. 1, thereby allowing the end 46B of the pawl 46 to engage with the engaging portion 14B.

Reference numeral 72 in FIGS. 1 and 2 denotes an injector, while numeral 68 denotes a coil spring for urging the ejector 72 in the direction of arrow B in FIG. 1. Accordingly, the tongue plate 12 inserted in the buckle body 17 is locked by the lock plate 22, and is constantly urged in the direction of withdrawal by the ejector 72. When the lock is canceled, the tongue plate 12 is pushed out of the buckle body 17 by the ejector 72.

A description will now be given of the operation of this embodiment.

When the release button 28 has been moved in the direction of arrow A in FIG. 1 through an operation by a vehicle occupant, the block 36 moves integrally with the release button 28 in the direction of arrow A in FIG. 1. Accordingly, neither of the pawls 40 and 46 engage the engaging portion 14B of the upper cover 14 (i.e., they remain in the state indicated by the solid lines in FIG. 1), and the release button 28 moves in the direction of arrow A in FIG. 1. As a result, the levers 19 swing in the direction of arrow C in FIG. 1, thereby disengaging the hook 22C from the engaging hole 26 of the tongue plate 12.

Meanwhile, when sudden acceleration simultaneously acts on both the release button 28 and the block 36 in the direction of arrow A in FIG. 1, the block 36 moves in the direction of arrow A in FIG. 1 with respect to the release button 28, and the pawl 40 swings in the direction of arrow C in FIG. 1, thereby causing the end 46B of the pawl 46 to engages the engaging portion 14B. For this reason, the movement of the release button 28 in the direction of arrow A in FIG. 1 is prevented, thereby making it possible to maintain the locked state of the tongue plate 12.

In addition, when sudden acceleration acts in the direction of arrow B in FIG. 1, the release button 28 is prevented from moving in the direction of arrow B in FIG. 1 by the levers 19, and only the block 36 moves in the direction of arrow B, so that the pawl 40 swings in the direction of arrow D. The pawl 40 thereby engages the engaging portion 14B.

Figure 3:
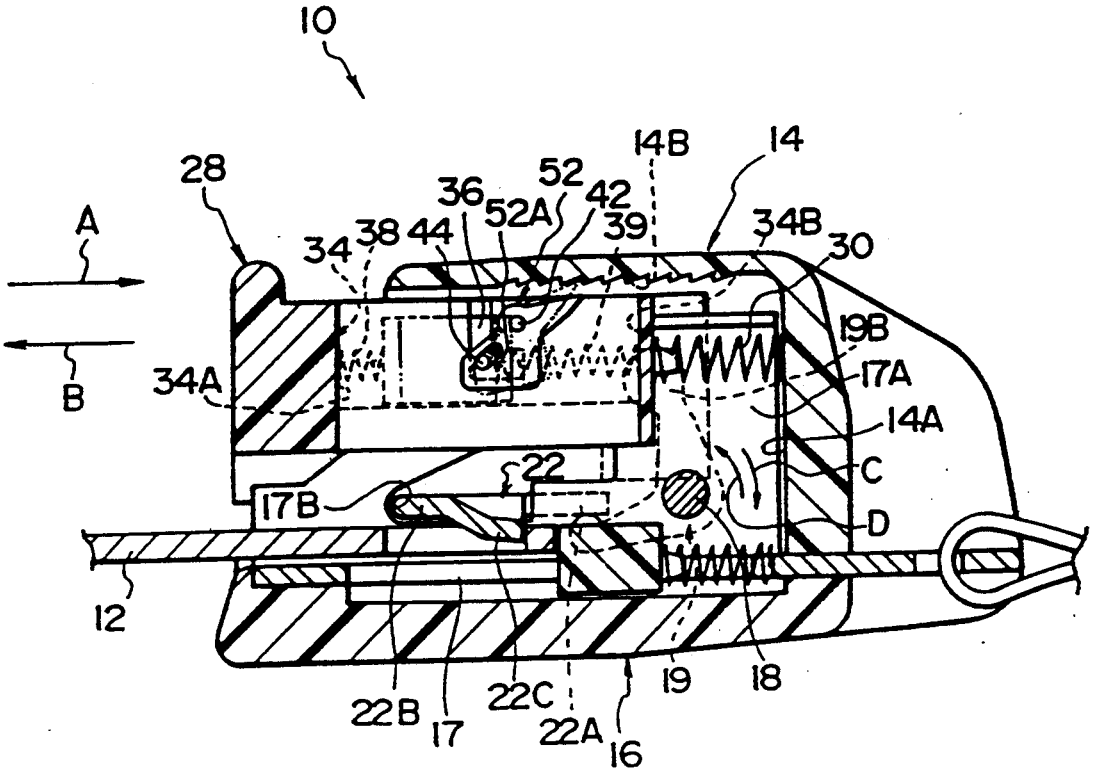
FIG. 3 is a cross-sectional view schematically illustrating the state of engagement of the tongue plate in another example of the buckle device in accordance with the first the present invention.

Although in the above-described embodiment, one end 46A of the pawl 46 is brought into contact with the pawl 40, an arrangement may be alternatively provided as shown in FIG. 3, in which, instead of the pawls 46, 40, a hole 52A provided in one end of a pawl 52 engages with the pin 44 provided projectingly on the block 36. When the block 36 moves in the direction of arrow A in FIG. 3 with respect to the release button 28, the pawl 52 swings in the direction of arrow D in FIG. 3 and engages the engaging portion 14B of the upper cover 14. In this case, the movement of the release button 28 in the direction of arrow B in FIG. 3 is prevented by an unillustrated stopper or the like which serves to prevent the release button 28 from becoming drawn out from the buckle body 17.

Figure 4A:
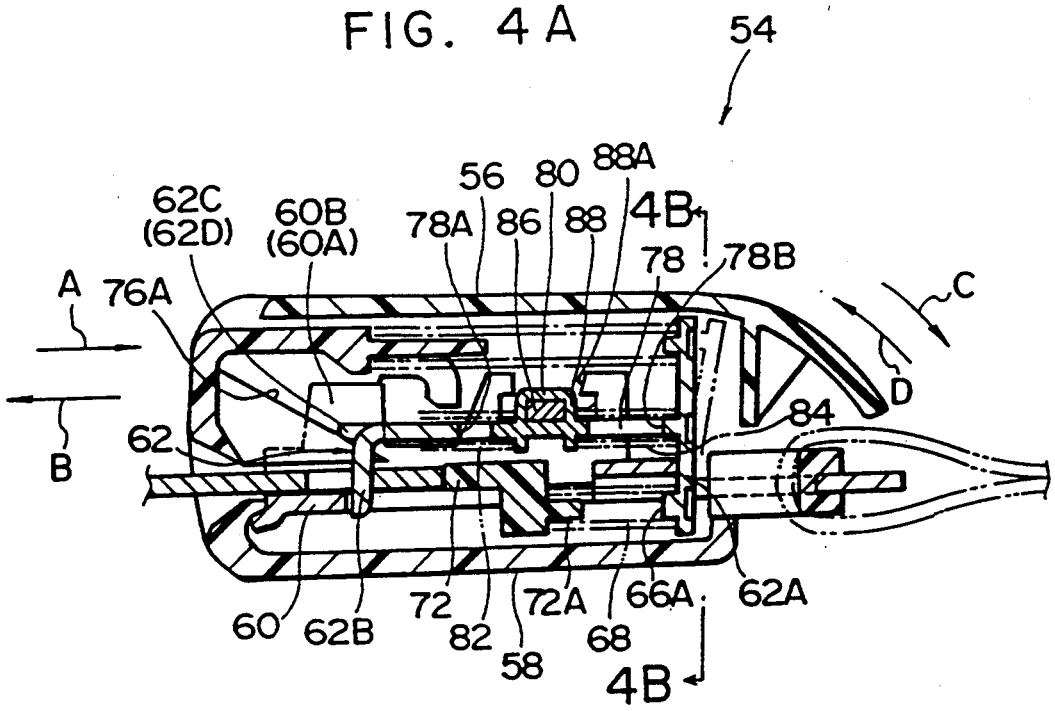
FIG. 4A is a cross-sectional view schematically illustrating a state of engagement of a tongue plate of a buckle device in accordance with a second embodiment of the present invention.
Figure 4B:
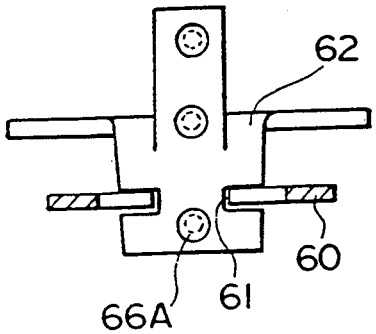
FIG. 4B a cross-sectional view taken along the line 4B—4B of FIG. 4A.
Figure 4C:
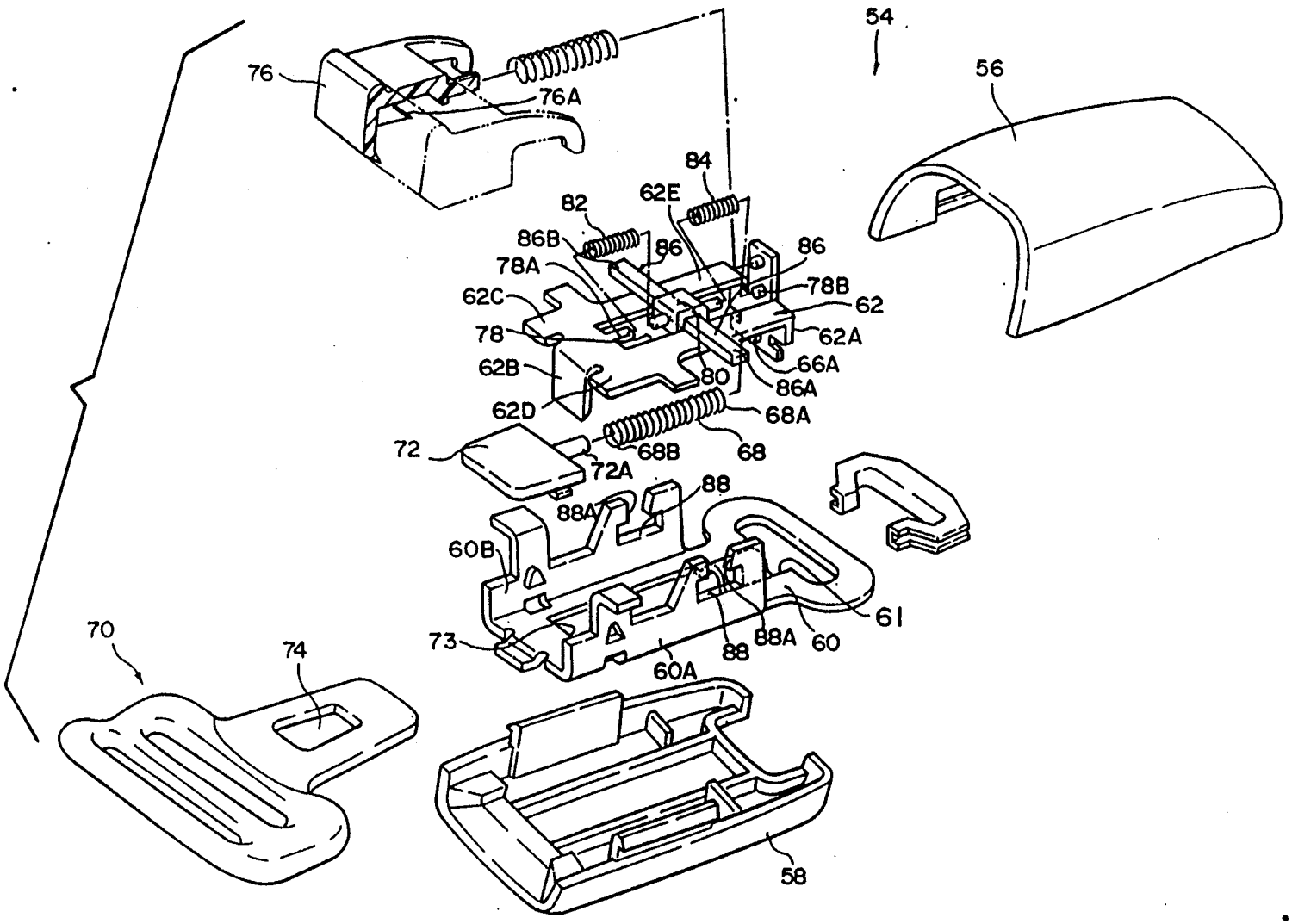
FIG. 4C an exploded perspective view of the buckle device in accordance with the second embodiment of the present invention.

Referring to FIGS. 4A, 4B, and 4C, a description will be given hereinunder of a second embodiment of the present invention.

As shown in FIGS. 4A and 4C, a buckle device 54 has a buckle body 60 interposed between an upper cover 56 and a lower cover 58. Side walls 60A, 60B are respectively provided uprightly on transversely opposite sides of the buckle body 60 along the horizontal direction as viewed in FIG. 4A (in the direction of arrow B or A in FIG. 4A).

In addition, a notch 61 is formed in a right lower end portion, as viewed in FIG. 4A, of the buckle body 60, as shown in FIGS. 4B, 4C. A lock plate 62 is supported by the buckle body 60 via this notch 61 in such a manner as to be swingable clockwise in FIG. 4A (in the direction of arrow C in FIG. 4A) and counterclockwise in FIG. 4A (in the direction of arrow D in FIG. 4A).

As shown in FIG. 4C, the lock plate 62 is formed in a U-shape, and one leg 62A thereof is inserted into the notch 61 in the direction from the upper cover 56 toward the lower cover 58. In addition, a projection 66 is provided on a left surface, as viewed in FIG. 4A, of a distal end of the leg 62A, one end 68A of the coil spring 68 being engaged with this projection 66. The other end 68B of the coil spring 68 is engaged with a projection 72A provided on a right surface, as viewed in FIG. 4A, of the ejector 72 disposed on the left side, as viewed in FIG. 4A, of the coil spring 68. The ejector 72 is slidable in the direction of arrow A or B in FIG. 4A along a guide hole 73 provided in the buckle body 60.

Accordingly, when the ejector 72 is operated by being pressed in the direction of arrow A in FIG. 4A by a tongue plate 70, the lock plate 62 is urged in the direction of arrow D in FIG. 4A by the urging force of the coil spring 68.

The other leg 62B of the lock plate 62 is inserted in the guide hole 73 of the tongue plate 70 in the direction from the upper cover 56 toward the lower cover 58. A pair of extensions 62C, 62D are formed on transversely opposite sides of an upper end portion of the leg 62B in such a manner as to extend toward the left side in FIG. 4A. Distal ends of these extensions 62C, 62D are bent slightly upward as viewed in FIG. 4A and abut against an inclined surface 76A of a right end, as viewed in FIG. 4A, of a release button 76 serving as a lock canceling means.

Accordingly, when the release button 76 slides in the direction of arrow A in FIG. 4A, the distal ends of the extensions 62C, 62D slide up the inclined surface 76A of the release button 76, with the result that the lock plate 62 swings in the direction of arrow C in FIG. 4A, thereby canceling the lock of the tongue plate 70.

A through hole 78 extending in the direction of arrow A in FIG. 4A is formed in a proximal portion 62E of the lock plate 62, and a lock bar holder 80 is inserted into the through hole 78 in such a manner as to be slidable in the direction of arrow A or B in FIG. 4A. Coil springs 82, 84 are respectively inserted between the lock bar holder 80 and the left and right ends 78A, 78B, as viewed in FIG. 4A, of the through hole 78 so as to hold the lock bar holder 80 in a substantially central portion of the through hole 78.

A lock bar 86 is inserted into the lock bar holder 80 in a direction perpendicular to the plane of the drawing of FIG. 4A. Longitudinally opposite ends 86A, 86B of the lock bar 86 are respectively inserted into notches 88 formed in the opposite side walls 60A, 60B. Each of these notches 88 is elongated in a horizontal direction in FIG. 4A. The longitudinally opposite ends 86A, 86B of the lock bar 86 are movable in the direction of arrow A or B in FIG. 4A along the respective notches 88. In addition, the upper side, as viewed in FIG. 4A, of each of the notches 88 is configured as a neck portion 88A formed in a central portion of the notch 88 in such a manner as to be slightly larger than the sectional size of the lock bar 86.

Accordingly, when the lock bar 86 is situated in the central portion of the notches 88, the opposite ends of the lock bar 86, when moved in the direction of arrow C, are capable of being drawn out from the notches 88 via the neck portions 88A. Therefore, the lock plate 62 become swingable in the direction of arrow C in FIG. 4A, so that when the lock bar 86 moves from the central portion of the notches 88 in the direction of arrow A or B in FIG. 4A, the lock bar 86 abuts against the inner sides of the neck portions 88A formed in the opposite side walls 60A, 60B of the buckle body 60, thereby rendering the lock plate 62 incapable of swinging in the direction of arrow C in FIG. 4A.

A description will be given hereinunder of the operation of this embodiment.

When the release button 76 is moved in the direction of arrow A in FIG. 4A through an operation by the occupant, since the lock bar 86 is situated in the central portions of the notches 88, the lock plate 62 swings in the direction of arrow C in FIG. 4A by means of the release button 76. For this reason, the leg 62B of the lock plate 62 disengages from an engaging hole 74 of the tongue plate 70.

Meanwhile, when sudden acceleration acts in the direction of arrow A in FIG. 4A, the lock bar 86 first moves in the direction of arrow A in FIG. 4A with respect to the release button 76, and the opposite ends 86A, 86B of the lock bar 86 are brought into contact with the opposite side walls 60A, 60B of the buckle body 60. For this reason, since the lock plate 62 is unable to swing in the direction of arrow C in FIG. 4A, even if the release button 76 moves in the direction of arrow A in FIG. 4A, it is possible to maintain the locked state of the tongue plate 70.

Figure 5:
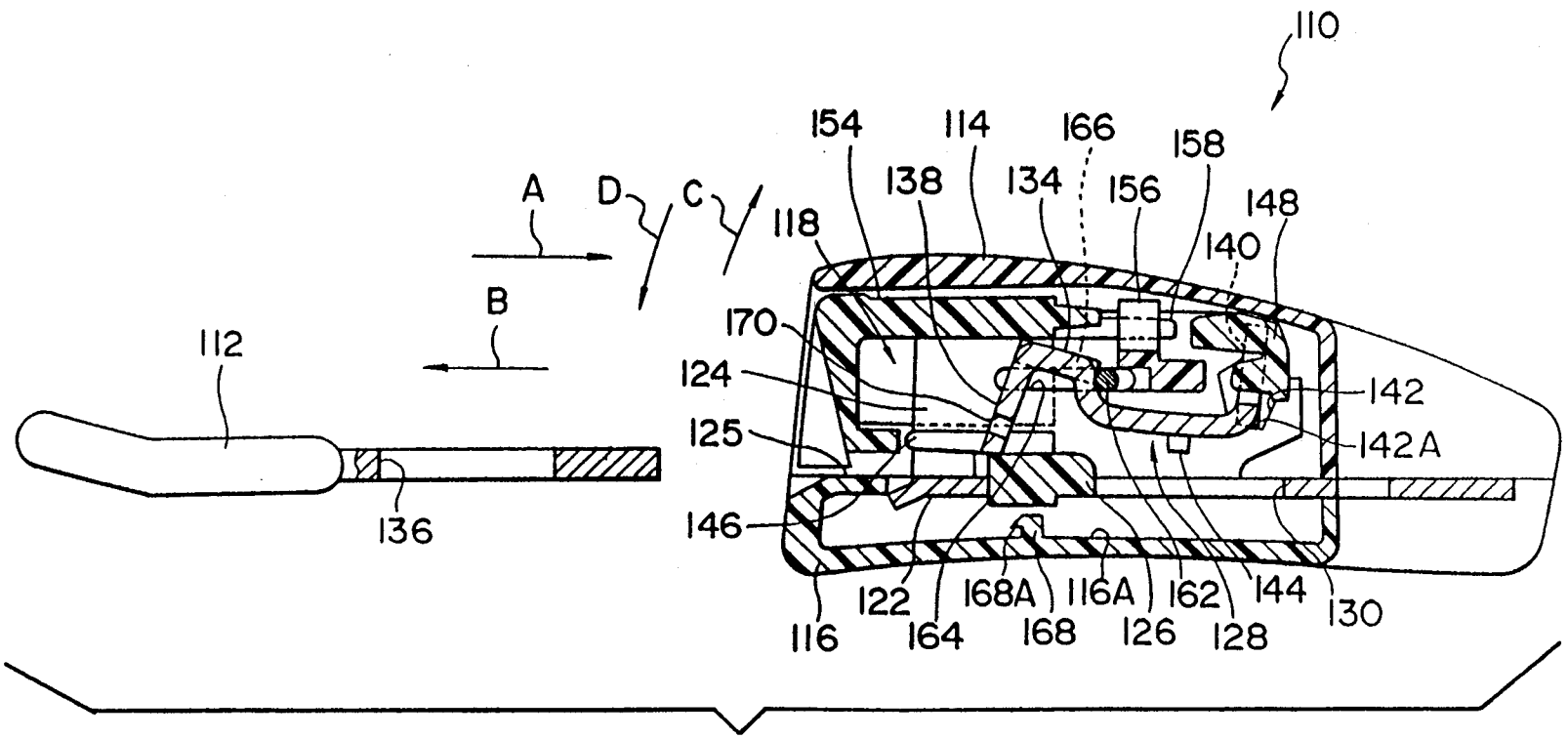
FIG. 5 is a cross-sectional view schematically illustrating a state which a tongue plate of a buckle device in accordance with a third embodiment of the present invention is drawn out.
Figure 6:
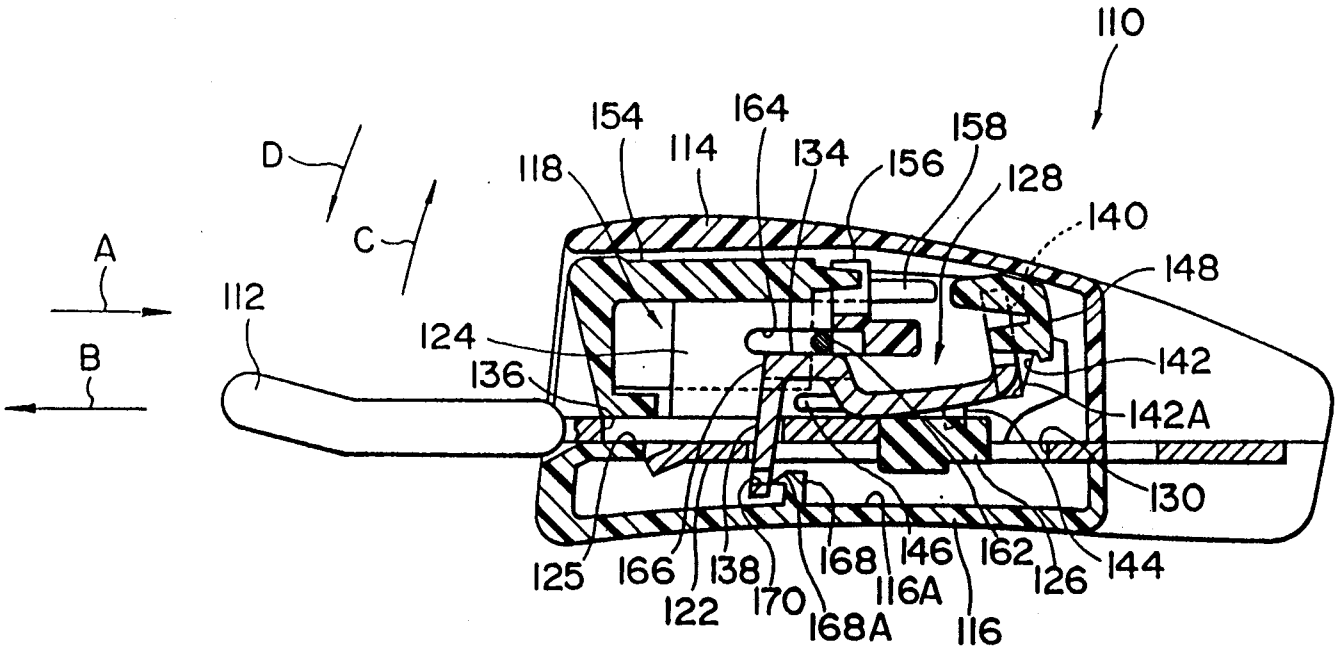
FIG. 6 is a cross-sectional view schematically illustrating a state of engagement of a tongue plate of a buckle device in accordance with the third embodiment of the present invention.
Figure 7:
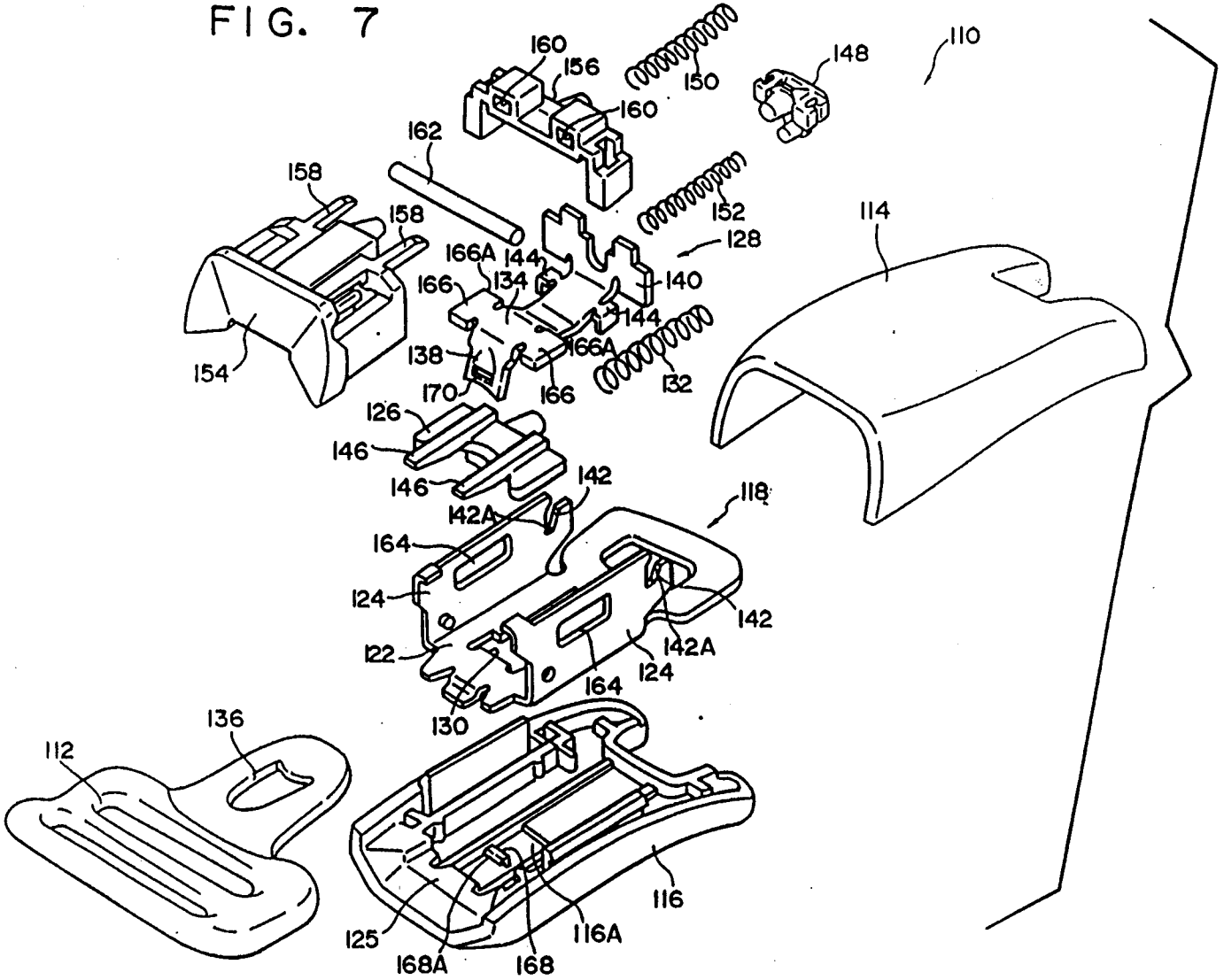
FIG. 7 is an exploded perspective view of the buckle device in accordance with the third embodiment of the present invention.

Referring now to FIGS. 5 to 7, a description will be given of a third embodiment of the present invention.

As shown in FIG. 5, a buckle device 110 has a buckle body 118 interposed between an upper cover 114 and a lower cover 116. In this buckle body 118, as shown in FIG. 7, a pair of leg plate portions 124 are formed integrally on transversely opposite sides of a flat plate portion 122 by bending. The arrangement is such that a tongue plate 112 is inserted between the pair of leg plate portions 124 through an opening 125 formed between the upper cover 114 and the lower cover 116.

As shown in FIG. 5, an ejector 126 and a lock plate 128 are provided between the pair of leg plate portions 124 of the buckle body 118.

The ejector 126 is inserted and disposed in a guide hole 130 formed in the flat plate portion 122 of the buckle body 118, and is movable in the direction of insertion and withdrawal of the tongue plate (in the direction of arrow A or B in FIGS. 5 and 6). One end of a coil spring 132 (shown in FIG. 7) is fitted to a right-hand end, as viewed in the injector 126, in the direction where the tongue plate 112 is inserted, while the other end is retained by the buckle body 118. The ejector 126 is thus urged in the direction of withdrawal of the tongue plate 112 (in the direction of arrow B in FIGS. 5 and 6) by means of this coil spring 132.

At the time of the insertion of the tongue plate 112, the distal end of the tongue plate 112 is brought into contact with the ejector 126. Thus, the tongue plate 112 is inserted as shown in FIG. 6, while moving the ejector 126 in the tongue plate inserting direction (in the direction of arrow A in FIG. 5) from the state of withdrawal of the tongue plate shown in FIG. 5.

The lock plate 128 is elongated in the direction of insertion and withdrawal of the tongue plate (in the direction of arrow A or B in FIGS. 5 and 6). A U-shaped portion 134 whose end is bent substantially perpendicularly downward is formed at a left end, as viewed in FIGS. 5 and 6, of the lock plate 128. A distal end portion of this U-shaped portion 134 is formed as an engaging portion 138 for engaging with an engaging hole 136 of the tongue plate 112. This engaging portion 138 is fitted in the engaging hole 136 of the tongue plate 112, as shown in FIG. 6, thereby engaging the lock plate 128 with the tongue plate 112. An upwardly rising portion 140 is formed at the other end (the right side in FIGS. 5 and 6) of the lock plate 128 located away from its U-shaped portion 134.

As shown in FIG. 7, the rising portion 140 is elongated in the transverse direction of the lock plate, and the lock plate 128 is trained between the pair of leg plate portions 124 of the buckle body 118 with its transversely opposite ends of the rising portion 140 supported by the leg plate portions 124. A substantially triangular notch 142 is formed in a right end, as viewed in FIGS. 5 and 6, of each of the leg plate portions 124. Transversely opposite ends of the rising portion 140 are inserted into the notches 142, thereby rendering the lock plate 128 swingable in the direction of disengagement from the tongue plate (in the direction of arrow C or D in FIGS. 5 and 6) with each bottom 142A as a center.

In addition, the bottom 142A of each of the notches 142 is wider than the thickness of the rising portion 140 of the lock plate 128, so that the lock plate 128 is adapted to move by a small amount in the direction of arrow A or B in FIG. 5.

With the tongue plate withdrawn, the lock plate 128 is set in a state in which it is swung in the direction of disengagement from the tongue plate (in the direction of arrow C in FIG. 5) as the end of the engaging portion 138 is brought into contact with an upper surface of the ejector 126, as shown in FIG. 5.

As shown in FIG. 7, the lock plate 128 has a pair of downwardly bent portions 144 formed on transversely opposite sides thereof at a longitudinally intermediate position between the U-shaped portion 134 and the rising portion 140. When the bent portions 144, in the tongue plate-withdrawn state shown in FIG. 5, are pressed in the tongue plate inserting direction 9 (in the direction of arrow A in FIG. 5), the lock plate 128 is swung in the direction of engagement with the tongue plate (in the direction of arrow D in FIG. 5). These bent portions 144 correspond to right ends, as viewed in FIGS. 5 and 6, of a block 146 which is integrally provided on an upper surface of the ejector 126. The arrangement is such that when the tongue plate 112 in the tongue plate-withdrawn state shown in FIG. 5 is inserted, the ejector 126 presses the bent portions 144 in the tongue plate inserting direction (in the direction of arrow A in FIG. 5), and is moved in the tongue plate inserting direction, as shown in FIG. 6, while swinging the lock plate 128 in the direction of engagement with the tongue plate (in the direction of arrow D in FIG. 5). The lock plate 128 is engaged with the tongue plate 112 as the tip of the engaging portion 138 is inserted in the engaging hole 136 of the tongue plate 112, as shown in FIG. 6, due to its swinging motion at that time.

A spring holder 148 retained by the rising portion 140 is fixed to the lock plate 128. One ends of two coil springs 150, 152 (shown in FIG. 7) are retained by the spring holder 148. The other ends of these two coil springs 150, 152 are respectively disposed more towards the tongue plate 112, as viewed in FIGS. 5 and 6, than the spring holder 148, and are retained by a release button 154 and a lock pin holder 156. Thus, the release button 154 and the lock pin holder 156 are respectively urged in the tongue plate withdrawing direction (in the direction of arrow B in FIGS. 5 and 6) by means of the coil springs 150, 152.

The release button 154 is disposed more towards the tongue plate 112, as viewed in FIGS. 5 and 6, than the lock pin holder 156, and are movable in the direction of insertion and withdrawal of the tongue plate (in the direction of arrow A or B in FIGS. 5 and 6). In addition, the release button 154 is movable in the tongue plate inserting direction (in the direction of arrow A in FIGS. 5 and 6) against the urging force of the coil spring 150 (shown in FIG. 7). A pair of blocks 158 are provided at a right-hand end, as viewed in FIGS. 5 and 6, of the release button 154 in such a manner as to project in the tongue plate inserting direction (in the direction of arrow A in FIGS. 5 and 6). The blocks 158 are inserted into rectangular holes 160 (shown in FIG. 7) provided in an upper end portion of the lock pin holder 156 in such a manner as to be axially movable, and correspond to an upper end of the rising portion 140 of the lock plate 128. These blocks 158 are arranged such that when the release button 154 in the state of engagement with the tongue plate is moved in the tongue plate inserting direction (in the direction of arrow A in FIG. 6) against the urging force of the coil spring 150 (shown in FIG. 7), the blocks 158 are brought into contact with the upper end of the rising portion 140 of the lock plate 128 midway during their movement, and press the rising portion 140 of the lock plate 128, thereby moving the lock plate 128 in the tongue plate inserting direction while swinging the same in the direction of disengagement with the tongue plate (in the direction of arrow C in FIG. 6). Due to this swinging, the lock plate 128 is adapted to cause the engaging portion 138 to be withdrawn from the engaging hole 136 of the tongue plate 112 from the state of its engagement with the tongue plate shown in FIG. 6.

The lock pin holder 156, which is urged by the coil spring 152 (shown in FIG. 7), is adapted to clamp a lock pin 162 (serving as a lock assisting member) between the same and the release button 154, as shown in FIG. 6, on the outer sides of the leg plate portions 124 of the buckle body 118 in the state of engagement of the tongue plate. The lock pin 162 is supported by the buckle body 118 with its axially opposite ends inserted in bearing holes 164 respectively provided in the leg plate portions 124 of the buckle body 118. The bearing holes 164 are elongated in the direction of insertion and withdrawal of the tongue plate (in the direction of arrow A or B in FIGS. 5 and 6) so as to support the lock pin 162 movably in the direction of insertion and withdrawal of the tongue plate.

The lock pin 162 corresponds to a pair of positioning plate portions 166 provided in the lock plate 128. As shown in FIG. 7, the positioning plate portions 166 extend in the transverse direction of the lock plate from its intermediate portion substantially orthogonal to the engaging portion 138 of the U-shaped portion 134. In the state of engagement of the tongue plate, the lock pin 162 abuts against the upper surfaces of the positioning plate portions 166, as shown in FIG. 6. In the state in which the tongue plate is withdrawn, the lock pin 162 abuts against the right end faces, as viewed in FIGS. 5 and 6, of the positioning plate portions 166, as shown in FIG. 5. More specifically, the lock pin in the state of engagement of the tongue plate is clamped by the lock pin holder 156 and the release button 154 and corresponds to the upper surfaces of the positioning plate portions 166. In the state in which the lock pin 162 corresponds to the upper surfaces of the positioning plate portions 166 (in the locking position), the lock plate 128 is prevented from swinging in the direction of disengagement from the tongue plate (in the direction of arrow C in FIG. 6) by means of the lock pin 162. When the lock pin 162 in this tongue plate engaging state is moved in the tongue plate inserting direction (in the direction of arrow A in FIG. 6) and is hence positioned more towards the tongue plate inserting direction as viewed in FIGS. 5 and 6, (i.e., the released position) than the right end faces, as viewed in FIGS. 5 and 6, of the positioning plate portions 166, the lock plate 128 becomes swingable in the direction of disengagement from the tongue plate (in the direction of arrow C in FIG. 6).

In addition, a protrusion 168 serving as an engagement assisting means is provided projectingly on a bottom 116A of the lower cover 116. A distal end portion of this protrusion 168 is bent orthogonally in the direction of withdrawal of the tongue plate 112 (in the direction of arrow B) so as to constitute a retaining claw 168A.

Meanwhile, a retaining hole 170 is provided in a distal end portion of the engaging portion 138 of the lock plate 128. In the event that the lock plate 128 moves in the direction of arrow A by means of an inertial force or the like, the retaining claw 168A of the protrusion 168 of the lower cover 116 fits into and engages with the retaining hole 170.

A description will now be given of the operation of this embodiment.

FIG. 5 illustrates a state in which the tongue plate 112 is not engaged with the buckle device 110. If the tongue plate 112 is inserted in the buckle device 110 in this state, the tip of the tongue plate 112 is brought into contact with the ejector 126 and presses the ejector 126 in the tongue plate inserting direction (in the direction of arrow A in FIG. 5) against the urging force of the coil spring 132. The tongue plate 112 is thus moved in the tongue plate inserting direction while the ejector 126 is being moved in the tongue plate inserting direction (in the direction of arrow A in FIG. 1).

During its movement, the ejector 126 is brought into contact with the bent portions 144 of the lock plate 128 and press the bent portions 144 of the lock plate 128 in the tongue plate inserting direction (in the direction of arrow A in FIG. 5). The ejector 126 is moved in the tongue plate inserting direction (in the direction of arrow A in FIG. 5) while swinging the lock plate 128 in the tongue plate engaging direction (in the direction of arrow D in FIG. 5). While the tongue plate 112 is being moved in the tongue plate inserting direction, the engaging portion 138 of the lock plate 128 is inserted into the engaging hole 136.

At this juncture, the lock pin 162 is movable in the tongue plate withdrawing direction (in the direction of arrow B in FIG. 5) by the swinging of the lock plate 128. The lock pin 162 moves in the tongue plate withdrawing direction through the urging of the coil spring 152 via the lock pin holder 156. For this reason, in the state in which the engaging portion of the lock plate 128 is fitted in the engaging hole 136 of the tongue plate 112, the lock pin is clamped by the lock pin holder 156 and the release button 154, and corresponds to the upper surfaces of the positioning plate portions 166 (locked position). This state is the tongue plate engaged position shown in FIG. 6.

Accordingly, in the tongue plate engaging state shown in FIG. 6, the lock plate 128 is prevented from swinging in the tongue plate disengaging direction (in the direction of arrow C in FIG. 6) by means of the lock pin 162, and the engaging portion 138 of the lock plate 128 is prevented from coming out of the engaging hole 136 of the tongue plate 112, so that the tongue plate 112 is not inadvertently removed from the buckle device 110.

In addition, when the inertial force acts in the direction of arrow A in the tongue plate engaging state shown in FIG. 6, the lock pin 162 moves in the direction of arrow A (in the direction of the releasing position) against the urging force of the coil spring 152. In this case, since the lock plate 128 also moves in the direction of arrow A by means of the inertial force, the retaining claw 168A of the protrusion 168 provided uprightly on the lower cover 116 fits in and engages with the retaining hole 170 provided in the engaging portion 138 of the lock plate 128. For this reason, the lock plate 128 is held in the tongue plate engaging state, and the state of engagement between the lock plate 128 and the tongue plate 112 is not canceled by the inertial force.

Meanwhile, the arrangement provided is such that the lock plate 162 is impossible to move in the direction of arrow B, C, or D, nor can it move in the axial direction thereof. Accordingly, with the buckle device of this embodiment, no matter from which direction the inertial force comes, the lock plate 128 is held in the tongue plate engaging state.

When the tongue plate 112 is to be released from the buckle device 110, the release button 154 is moved by the occupant in the tongue plate inserting direction (in the direction of arrow A in FIG. 6) against the urging force of the coil spring 150. With the lock pin 162 clamped by the release button 154 and the lock pin holder 156, the release button 154 is moved in the tongue plate inserting direction while moving the lock pin 162 and the lock pin holder 156 in the tongue plate inserting direction (in the direction of arrow A in FIG. 6) against the urging force of the coil spring 152 (shown in FIG. 7).

After the lock pin 162 is situated more towards the tongue inserting direction, as viewed in FIG. 6, than the positioning plate portions 166 of the lock plate 128 due to the aforementioned movement, the block 158 of the release button 154 is brought into contact with the upper end portion of the rising portion 140 of the lock plate 128. As a result, the release button 154 presses the rising portion 140 of the lock plate 128 in the tongue plate inserting direction, and is further moved in the tongue plate inserting direction while swinging the lock plate 128 in the tongue plate releasing direction (in the direction of arrow C in FIG. 6).

The engaging portion 138 of the lock plate 128 disengages from the engaging hole 136 of the tongue plate 112 owing to the swinging motion at that time. At the same time, the ejector 126 is urged by the coil spring 132 and moved in the tongue plate withdrawing direction (in the direction of arrow B in FIG. 6), and the tongue plate 112 springs out of the buckle device 110 by being pressed by the ejector 126, thereby returning to the state shown in FIG. 5.

Figure 8:
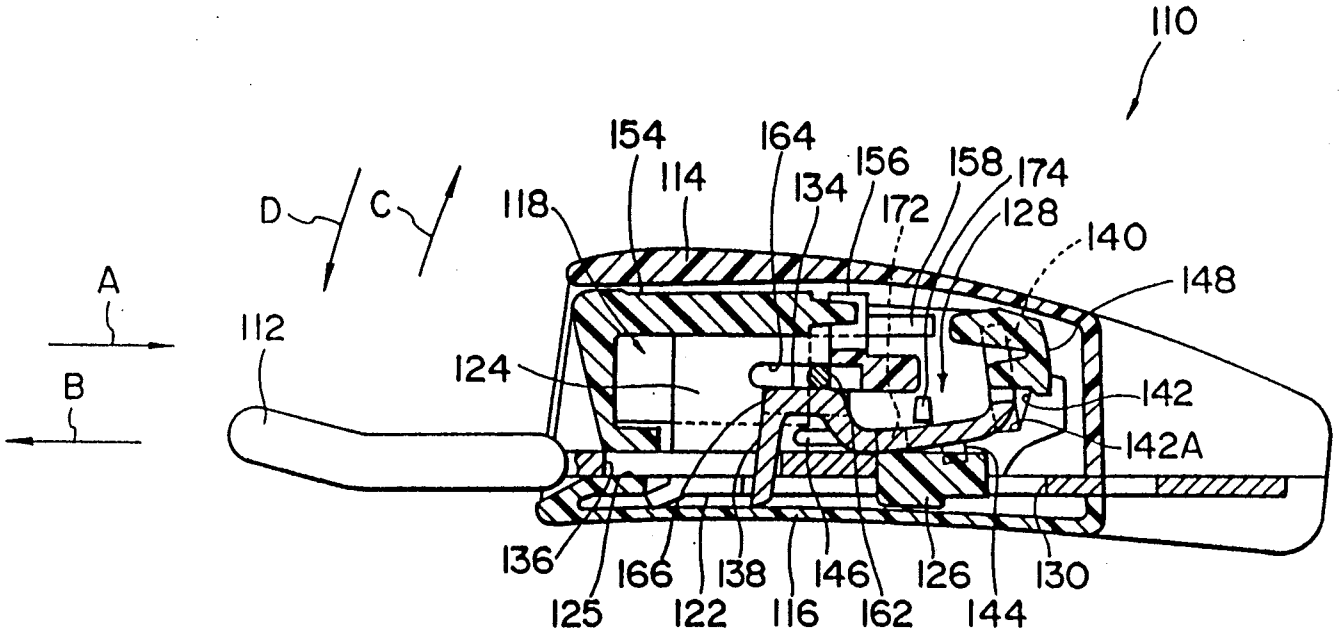
FIG. 8 is cross-sectional view schematically illustrating a state of engagement of a tongue plate of a buckle device in accordance with a fourth embodiment of the present invention.
Figure 9:
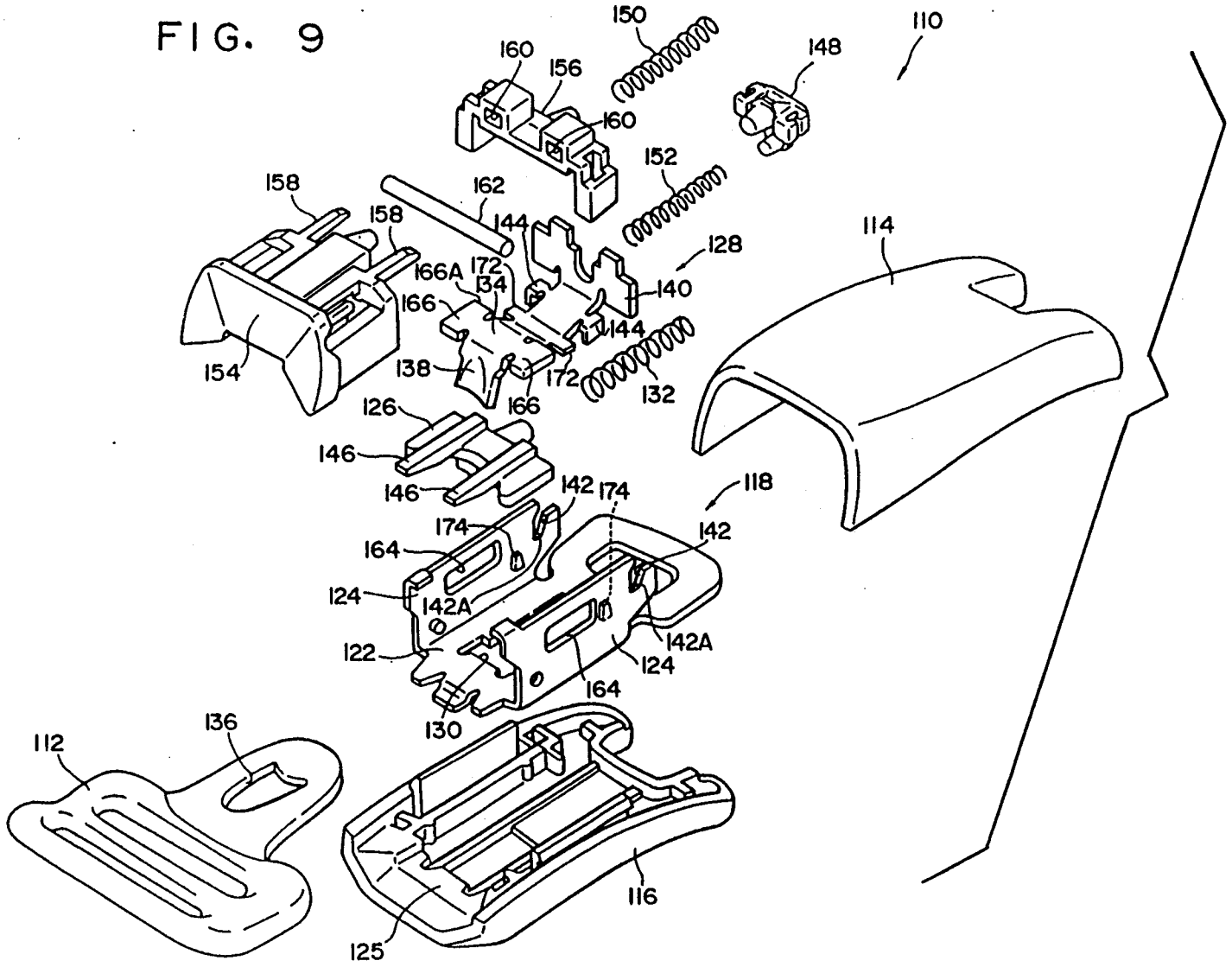
FIG. 9 is an exploded perspective view of the buckle device in accordance with the fourth embodiment of the present invention.

Referring now to FIGS. 8 and 9, a description will be given of a fourth embodiment of the present invention.

Members that are identical with those of the third embodiment will be denoted by the same reference numerals, and a description thereof will be omitted.

As shown in FIGS. 8 and 9, a pair of retaining projections 172 serving as one part of an emergency lock means are formed between the U-shaped portion 134 and the bent portions 144 of the lock plate 128, respectively. A pair of retaining projections 174 serving as another part of the emergency lock means are respectively formed on the inner sides of the leg plate portions 124 of the buckle device 118 corresponding to the retaining projections 172 at positions located on the right side, as viewed in FIG. 8, of the leg plate portions 124. The arrangement is such that when the lock plate 128 moves in the direction of arrow A by an inertial force or the like, the retaining projections 172 of the lock plate 128 move and are caught at the left sides, as viewed in FIG. 8, of the retaining projections 174 of the buckle body 118, thereby holding the lock plate 128 in the tongue plate engaging state.

Accordingly, in this fourth embodiment as well, it is possible to obtain the same effect as in the third embodiment.

Figure 10:
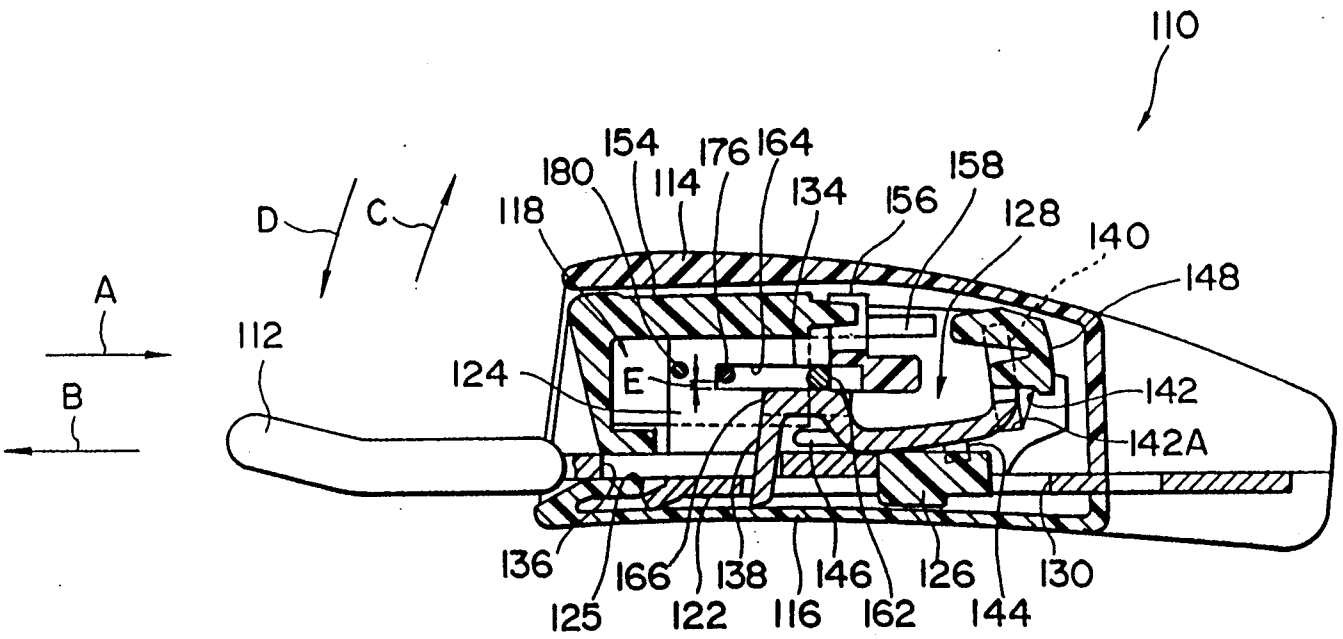
FIG. 10 is a cross-sectional view schematically illustrating a state of engagement of a tongue plate of a buckle device in accordance with a fifth embodiment of the present invention.
Figure 11:
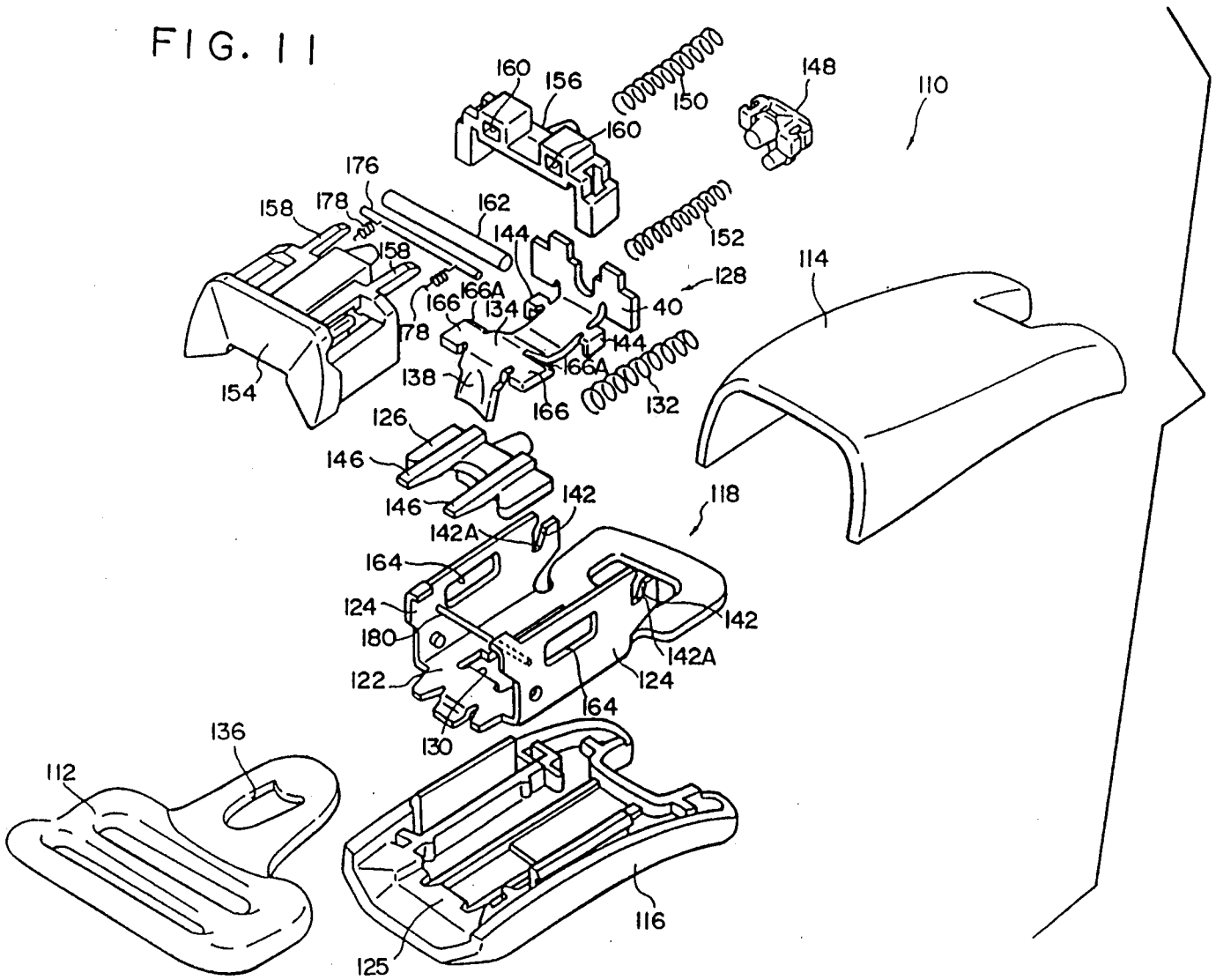
FIG. 11 is an exploded perspective view of the buckle device in accordance with the fifth embodiment of the present invention.

Referring now to FIGS. 10 and 11, a description will be given of a fifth embodiment of the present invention.

Members that are identical with those of the third embodiment will be denoted by the same reference numerals, and a description thereof will be omitted.

As shown in FIGS. 10 and 11, an auxiliary lock pin 176 serving as an emergency lock means is disposed in the bearing holes 164 of the buckle body 118 in parallel with the lock pin 162 on the left side, as viewed in FIG. 10, thereof. Axially opposite ends of the auxiliary lock pin 176 are inserted in the bearing holes 164 and abut against the upper inner peripheral surfaces, as viewed in FIG. 10, of the bearing holes 164. The diameter of this auxiliary lock pin 176 is slightly smaller (dimension E in FIG. 10) than the diameter of the lock pin 162. In addition, one end of a pair of coil springs are respectively secured to the vicinity of the opposite ends of the auxiliary lock pin 176, while the other ends of the coil springs 178 are respectively retained by a shaft 180 having axially opposite ends secured to the leg plate portions 124 of the buckle body 118.

Accordingly, when an inertial force has acted in the direction of arrow A, the auxiliary lock pin 176 moves rightward, as viewed in FIG. 10, into the U-shaped portion 134 of the lock plate 128, i.e., to the locking position of the lock pin 162 against the urging forces of the coil springs 178. For this reason, the lock plate 128 is held in the tongue plate engaging state by the auxiliary lock pin 176 instead of the lock pin 162. In consequence, the state of engagement between the lock plate 128 and the tongue plate 112 is not canceled by the inertial force.

Furthermore, the modulus of elasticity of the coil springs 178 is set to be small. In addition, the diameter of the auxiliary lock pin 176 is smaller than that of the lock pin 162, so that when the lock pin 162 is in the locking position, a gap E is formed between the auxiliary lock pin 176 and the lock plate 128. Accordingly, when the inertial force has acted in the direction of arrow A, the auxiliary lock pin 176 is capable of moving more quickly to the locking position than the lock pin 162.

Figure 12:
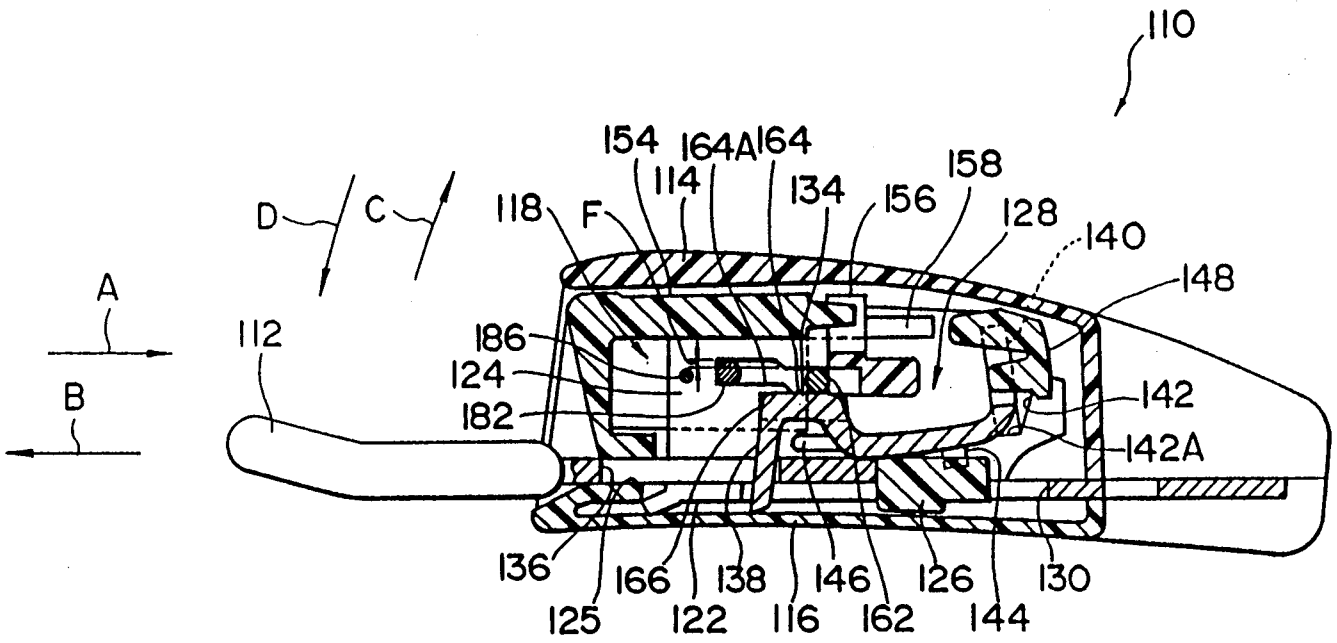
FIG. 12 is a cross-sectional view schematically illustrating a state of engagement of a tongue plate of a buckle device in accordance with a sixth embodiment of the present invention.
Figure 13:
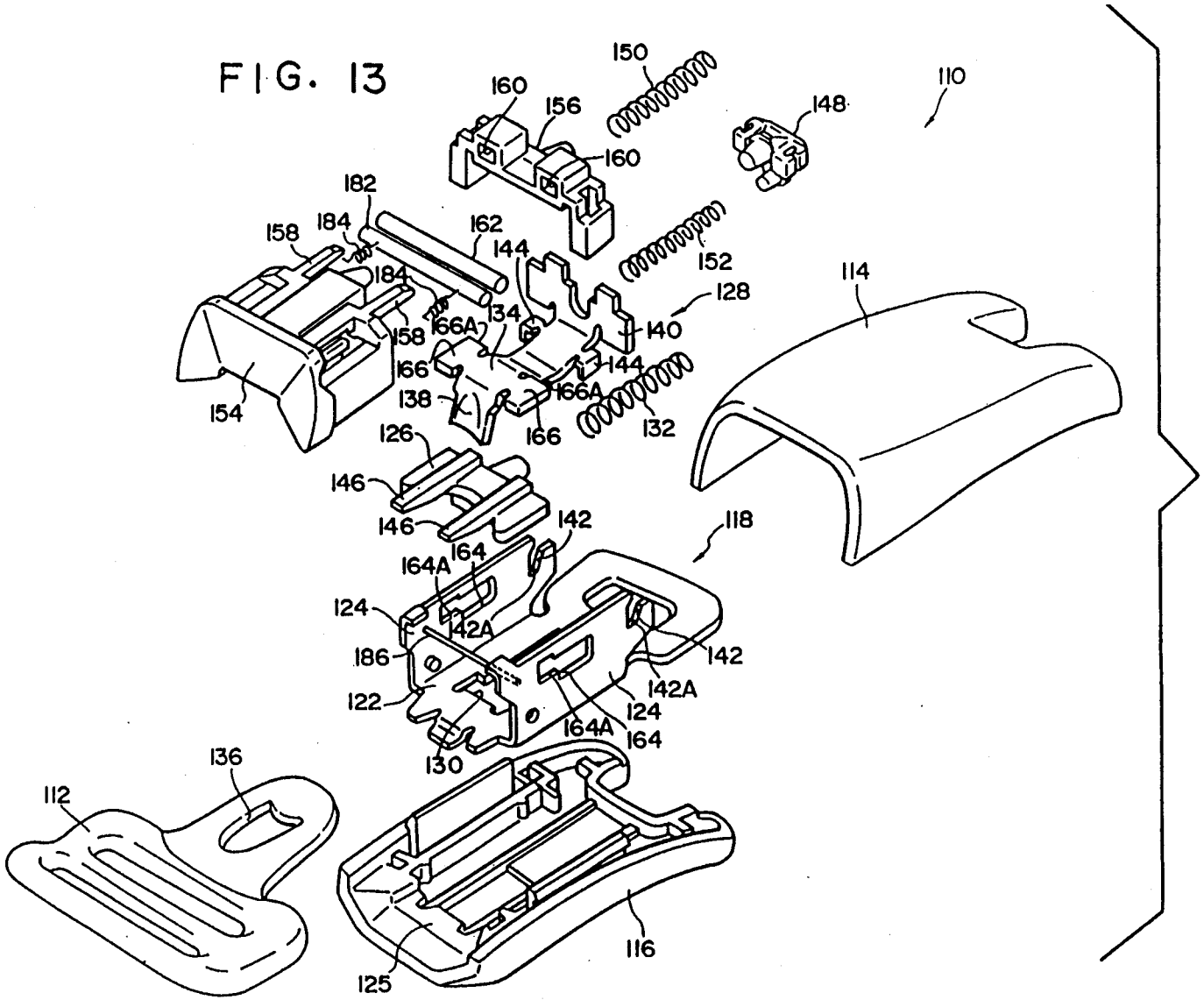
FIG. 13 is an exploded perspective view of the buckle device in accordance with the sixth embodiment of the present invention.

Referring now to FIGS. 12 and 13, a description will be given of a sixth embodiment of the present invention.

It should be noted that members that are identical with those of the third embodiment will be denoted by the same reference numerals, and a description thereof will be omitted.

As shown in FIGS. 12 and 13, the bearing holes 164 of the buckle device 118 are enlarged upwardly, as viewed in FIG. 12, in parallel by a small amount (dimension F in FIG. 12) at their left ends as viewed in FIG. 12, thereby forming a pair of stepped portions 164A. An auxiliary lock pin 182 serving as an emergency lock means is disposed on the left side, as viewed in FIG. 12, of the lock pin 162 in parallel therewith. Axially opposite ends of the auxiliary lock pin 182 are inserted into the bearing holes 164 and abut against the inner peripheral surfaces of the stepped portions 164A of the bearing holes 164. In addition, the diameter of the auxiliary lock pin 182 is made identical with that of the lock pin 162.

One end of a pair of coil springs 184 are respectively secured to the vicinity of the axially opposite ends of the auxiliary lock pin 182, while the other ends of the coil springs 184 are respectively retained by a shaft 186 having axially opposite ends secured to the leg plate portions 124 of the buckle body 118.

Accordingly, when an inertial force acts in the direction of arrow A, the auxiliary lock pin 182 moves rightward, as viewed in FIG. 12, into the U-shaped portion 134 of the lock plate 128, i.e., to the locking position against the urging forces of the coil springs 184. For this reason, the lock plate 128 is held in the tongue plate engaging state by the auxiliary lock pin 182 instead of the lock pin 162. In consequence, the state of engagement between the lock plate 128 and the tongue plate 112 is not canceled by the inertial force.

Furthermore, the modulus of elasticity of the coil springs 184 is set to be small. In addition, the stepped portions 164A of the bearing holes 164 are offset upwardly, as viewed in FIG. 12, by the dimension F above the portions of the bearing holes 164 abutting against the lock pin 162, so that when the lock pin 162 is in the locking position, the gap E is formed between the auxiliary lock pin 182 and the lock plate 128. Accordingly, when the inertial force acts in the direction of arrow A, the auxiliary lock pin 182 is capable of moving more quickly to the locking position than the lock pin 162.

Figure 14:
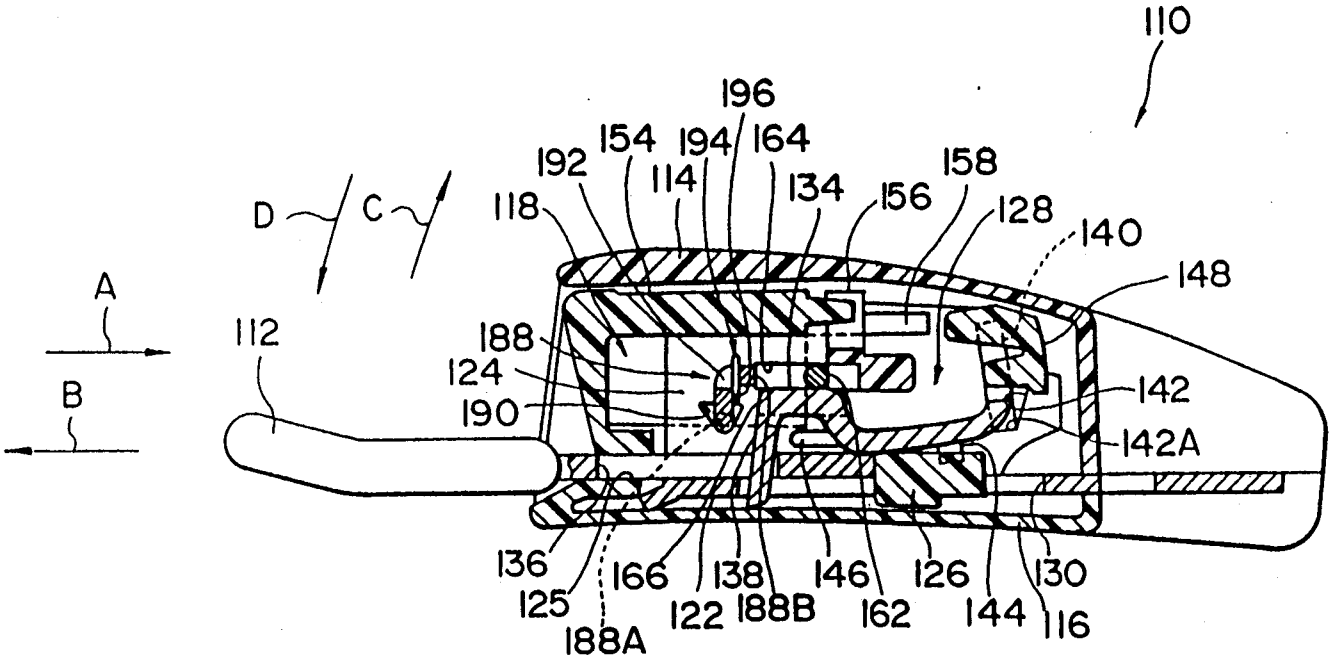
FIG. 14 is a cross-sectional view schematically illustrating a state of engagement of a tongue plate of a buckle device in accordance with a seventh embodiment of the present invention.
Figure 15:
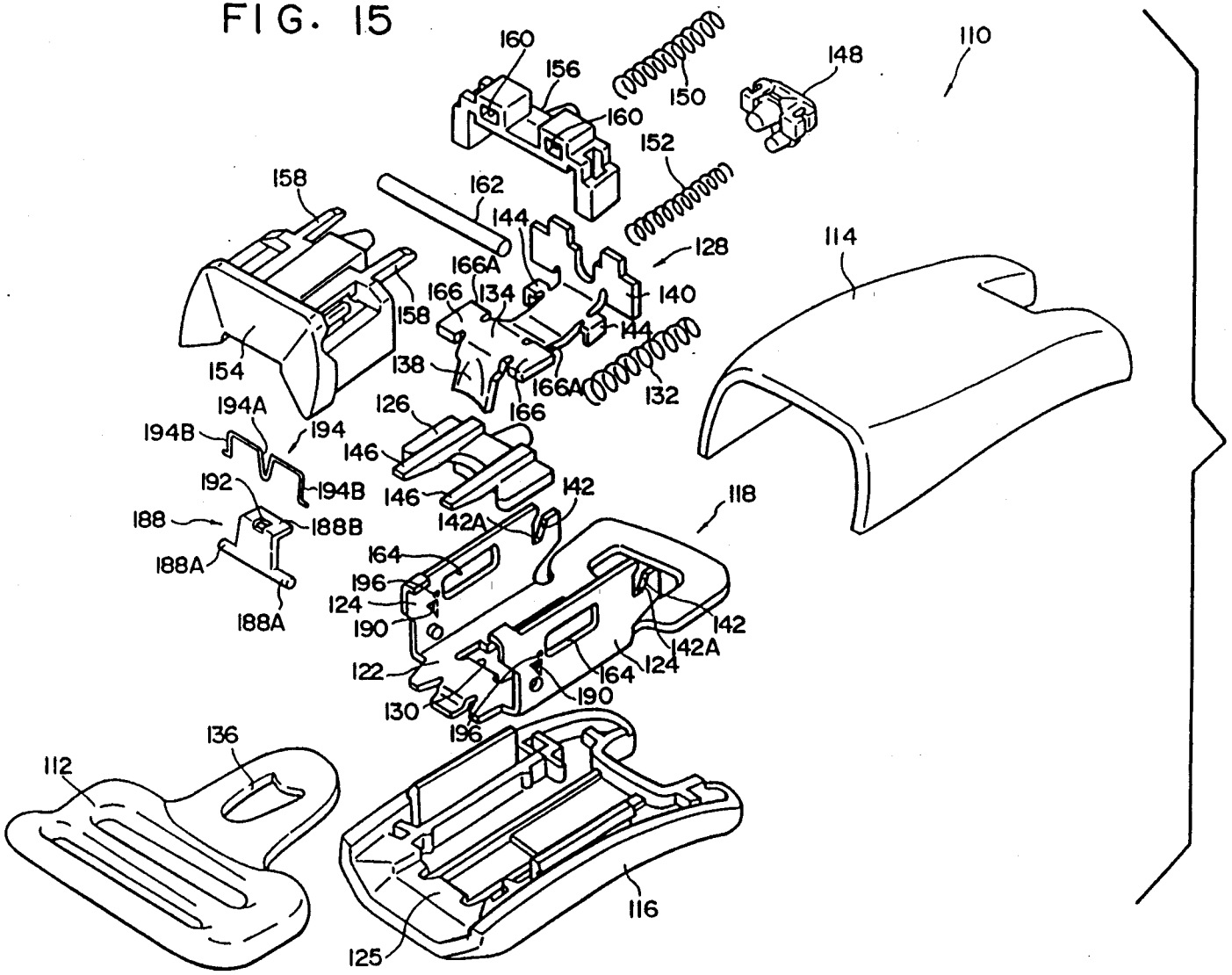
FIG. 15 an exploded perspective view of the buckle device in accordance with the seventh embodiment of the present invention.

Referring now to FIGS. 14 and 15, a description will be given of a seventh embodiment of the present invention.

It should be noted that members that are identical with those of the third embodiment will be denoted by the same reference numerals, and a description thereof will be omitted.

As shown in FIGS. 14 and 15, a sub-lock plate 188 serving as an emergency lock means is disposed on the left side, as viewed in FIG. 14, of the lock plate 128. This sub-lock plate 188 is formed of a plate bent into an L-shaped configuration, and a pair of projections 188A extend transversely from transversely opposite sides of an end of one bent piece thereof. These projections 188A are respectively inserted in through holes 190 provided in the leg portions 124 of the buckle body 118, so that the sub lock plate 188 is swingable in the direction of arrow A or B with the projections 188A as the center of rotation.

A through hole 192 is provided vertically, as viewed in FIG. 14, in a central bent portion of the sub-lock plate 188, and a central bent portion 194A of a wire spring 194 is inserted into this through hole 192. Opposite ends 194B of the wire spring 194 are bent into L-shaped configurations, and are engaged with through holes 196 provided in the leg plate portions 124 of the buckle body 118, respectively.

The other bent piece 188B of the sub-lock plate 188 is oriented in the direction of arrow A, and when the sub lock plate 188 has swung in the direction of arrow A, the tip of the bent piece 188B is adapted to be located on the right side, as viewed in FIG. 14, of the U-shaped portion 134 of the lock plate 128.

Accordingly, when the inertial force acts in the direction of arrow A, the sub-lock plate 188 swings in the direction of arrow A against the urging force of the spring 194, so that the bent piece 188B moves to the locking position of the lock pin 126. For this reason, the lock plate 128 is held in the tongue plate engaging state by the sub lock plate 188 instead of the lock pin 162. In consequence, the state of engagement between the lock plate 128 and the tongue plate 112 is not canceled by the inertial force.

Furthermore, the modulus of elasticity of the wire spring 194 is set to be small. In addition, the bent portion 188B is offset upwardly, as viewed in FIG. 14, by a small amount above contact surfaces between the lock pin 162 and the U-shaped portion 134 of the lock plate 128. Hence, when the lock pin 162 is in the locking position, a gap is formed between the bent piece 188B of the sub lock plate 188 and the U-shaped portion 134 of the lock plate 128.

Accordingly, when the inertial force acts in the direction of arrow A, the bent piece 188B of the sub-lock plate 188 is capable of moving more quickly to the locking position than the lock pin 162.

Figure 16:
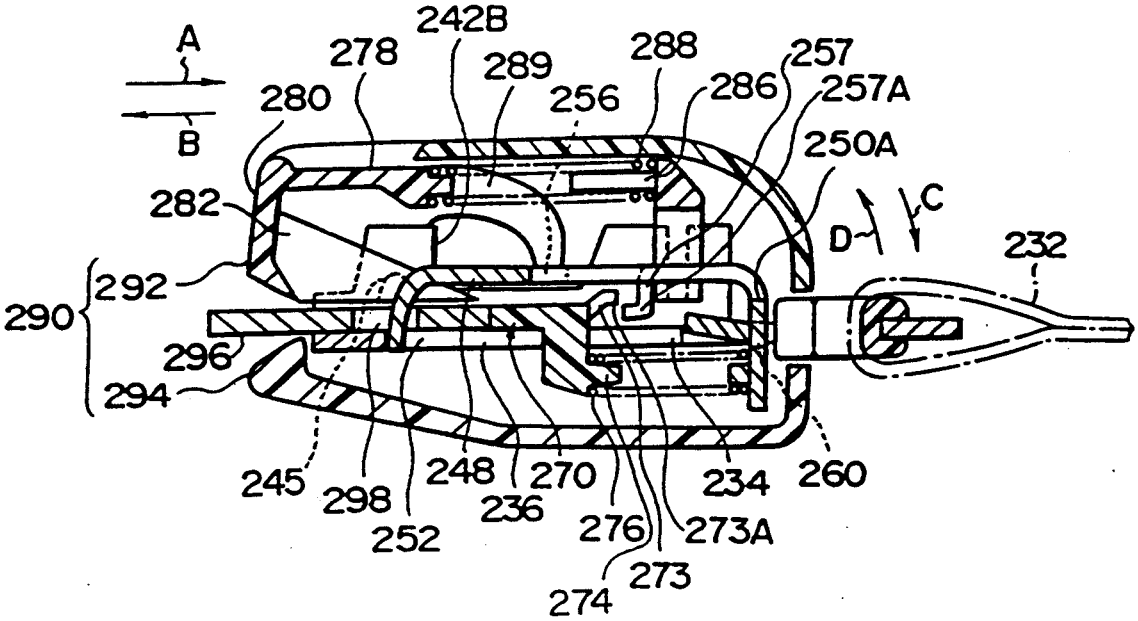
FIG. 16 is a cross-sectional view schematically illustrating a state of engagement of a tongue plate of a buckle device in accordance with an eighth embodiment of the present invention.
Figure 17:
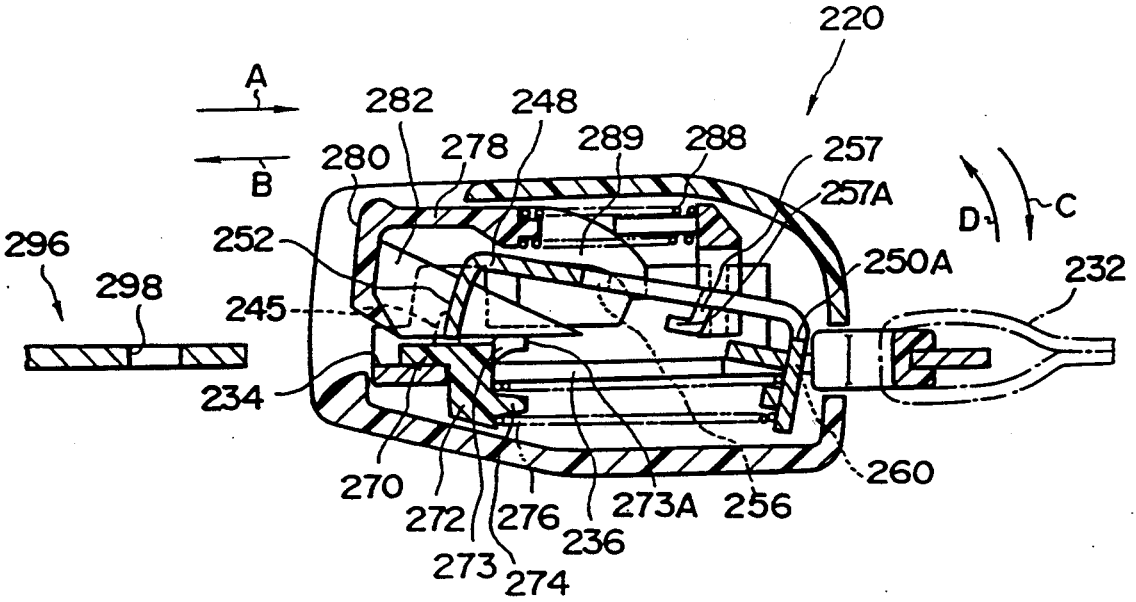
FIG. 17 is a cross-sectional view schematically illustrating a state which the tongue plate of the buckle device in accordance with the eighth embodiment of the present invention is drawn out.
Figure 18:
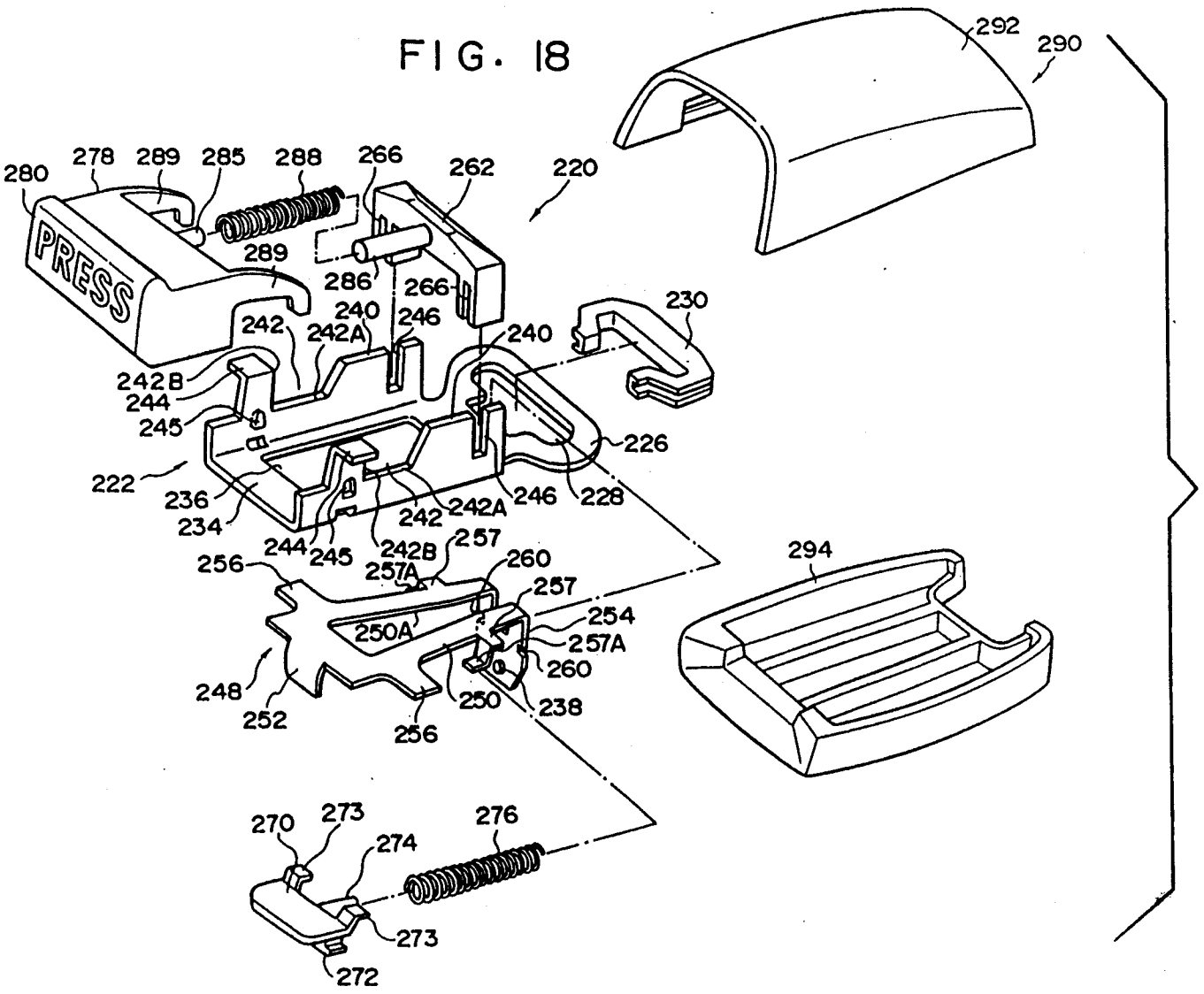
FIG. 18 is an exploded perspective view of the buckle device in accordance with the eighth embodiment of the present invention.

Referring now to FIGS. 16 to 18, a description will be given of an eighth embodiment of the present invention.

As shown in FIG. 18, main component parts of a buckle device 220 are accommodated in a buckle body 222. The buckle body 222 is formed by processing a plate material having a predetermined strength. A connecting portion 226 is formed at one end thereof. An opening 228 is formed in the connecting portion 226, and one end of a strap 232 (see FIGS. 16 and 17) is connected to this opening 228 via a protector 230. The other end of the strap 232 is secured to the chassis via an anchor plate or the like.

In the buckle body 222, an opening 236 is formed in a base plate portion 234 serving as a base bottom for connection with the connecting portion 226. Also, in the buckle body 222, a pair of substantially rectangular notches 242, 242 are formed in upper intermediate portions of a pair of leg plate portions 240, 240 provided uprightly from transversely opposite sides of the base plate portion 234 and are in parallel with each other. In addition, a pair of guide flanges 244, 244 projecting outwardly from the leg plate portions 240, 240 are formed on front sides, i.e., left sides as viewed in FIG. 16, of the leg plate portions 240, 240 adjacent to the aforementioned notches 242, 242. A pair of projections 245, 245 for positioning a tongue plate 296 (see FIG. 16) by restricting its upward movement are formed below the guide flanges by being stamped out inwardly of the leg plate portions 240, 240. Furthermore, notches 246, 246 are formed on front sides, i.e., right sides as viewed in FIG. 16, of the leg plate portions 240, 240.

Formed in a lock plate 248 is a hook 252 bent downwardly at a central portion of a front end of a central flat plate portion 250 as well as a hinge 254 bent downwardly at a front end of the central flat plate portion 250. A pair of projections 256, 256 are formed at a forward position of the central flat plate portion 250 in such a manner as to project outwardly from transversely opposite sides of the central flat plate portion 250. A slot 250A extending longitudinally and reaching the hinge 254 is formed in a central portion of the central flat plate portion 250. This slot 250A is formed into a tapered configuration having a diminished width at the hinge 254 side. A pair of notches 260 , 260 are formed on opposite sides of an intermediate portion of the hinge 254. The side surface of the pawl 252 is formed into an arcuate configuration with the notches 260 as the center, as shown in FIG. 16. In addition, a projection 238 is formed at a distal end of the hinge 254 in such a manner as to project toward the pawl 252.

As for the lock plate 248, the hinge 254 is inserted into the opening 228 formed in the connecting portion 226, and the notches 260, 260 formed in the hinge 254 are retained by the connecting portion 226, thereby rendering the lock plate 248 swingable with respect to the buckle body 222. The aforementioned protector 230 is fitted in the opening 228 after the lock plate 248 is inserted, as described above, and also functions as a stopper for preventing the lock plate 248 from coming out. In addition, a rear surface of the lock plate 248 on the front side thereof, including the projections 256, 256, is capable of abutting against bottom surfaces 242A, 242A of the notches 242, 242 formed in the buckle body leg plate portions 240, 240. With the lock plate 248 abutting against the bottom surfaces 242A, 242A, the end of the hook 252 is situated in the opening 236 formed in the buckle body base plate portion 234.

One end of a compression coil spring 276 having the other end supported by an ejector 270 is retained to the projection 238 of the lock plate 248. The lock plate 248 is urged by the compression coil spring 276 and counterclockwise torque, as viewed in FIG. 16, (in the direction of arrow D) is imparted to the lock plate 248 with the notches 260, 260 formed in the hinge 254 serving as a fulcrum.

In addition, a pair of projections 257, 257 serving as a part of an emergency lock means is formed rearwardly of the projections 256, 256 of the central flat plate portion 250 in parallel with the projections 256, 256. Front end portions of these projections 257, 257 are bent downwardly, and are then further bent forwardly, thereby forming L-shaped hooks 257A, 257A.

An upper portion of the ejector 270 is formed into a flat rectangular shape having a width greater than the width of the opening 236 formed in the flat plate portion of the buckle body 222. A guide portion 272 fitting slidably into the opening 237 is formed in a lower rear portion of the ejector 270. A spring support 274 is formed projectingly at the rear of the ejector 270. A compression coil spring 276 is disposed between the spring support 274 and the projection 238 of the hinge 254 of the lock plate 248 so as to urge the ejector 270 leftwards as viewed in FIG. 16 (in the direction of arrow B in FIG. 16). In addition, a pair of hooks 273, 273 serving as another part of the emergency lock means are formed at transversely opposite ends of the ejector 270 in such a manner as to project upward. Distal ends 273A, 273A of the hooks 273, 273 are bent rearwardly, and when the ejector 270 moves rightward as viewed in FIG. 16 (in the direction of arrow A in FIG. 16), the distal ends 273A, 273A engage the hooks 257A, 257A of the lock plate 248 (the state shown in FIG. 19).

A holder 262 is retained by the buckle body 222 with its notches 266, 266 fitted to the notches 246, 246 formed in the buckle body leg plate portions 240, 240.

As shown in FIG. 16, a release button 278 has a pair of wedge-shaped inclined guide portions 282, 282 (only one is shown in the drawing) formed at the inner side of an operating portion 280. These inclined guide portions 282, 282 are brought into contact with a rear surface of the lock plate 248. The release button 278 is movable in the direction of arrow A in FIG. 16 by being guided by the guide flanges 244, 244 with rail grooves (not illustrated) fitted to the guide flanges 244, 244 formed in the buckle body leg plate portions 240, 240.

A spring support 285 is formed on the release button 278, and a compression coil spring 288 is interposed between the support 285 and a spring support 286 formed on the holder 262. As a result, the release button 278 is urged in the direction of arrow B in FIG. 16. A pair of holding arms 289, 289 with their ends bent into the configuration of hooks are formed on opposite sides of the release button 278, and these holding arms 289, 289 are positioned in such a manner as to clamp the buckle body leg plate portions 240, 240 from opposite sides thereof.

A buckle cover 290 is composed of an upper cover 292 and a lower cover 294, and is secured to the buckle body 222, covering the base plate portion 234 and leg plate portions 240, 240.

As shown in FIG. 16, the tongue plate 296 has a rectangular opening 298 formed on end tip side, and the horizontal length, as viewed in FIG. 16, of this opening 298 is set to be longer than the thickness of the hook 252, so that the tongue plate 296 is movable in the direction of arrow A or B in FIG. 6. In addition, one end of an unillustrated webbing is attached to the rear end side (left side in FIG. 16) of the tongue plate 296. The other end of the webbing is secured to the chassis via an anchor plate or the like.

The operation of this embodiment will be described hereinunder.

FIG. 17 illustrates a state before the tongue plate 296 is engaged with the buckle device 220. In this state, the ejector 270 is situated at its forward limit by being urged by the compression coil spring 276. Its guide portion 272 abuts against an end face of the opening 236 formed in the buckle body base plate portion 234. The hook 252 of the lock plate 248 abuts against the upper surface of the ejector 270. The lock plate 248 is urged by the compression coil spring 276 and the counterclockwise torque in FIG. 17 (in the direction of arrow D in FIG. 17) is hence imparted to the lock plate 248, so that the hook 252 presses the upper surface of the ejector 270. Although the release button 278 is urged in the direction of arrow B in FIG. 1 by means of the compression coil spring 288, the tips of the holding arms 289, 289 are retained by the projections 256, 256 of the lock plate 248, so that the release button 278 has not reached its forward limit.

In this state, if the tongue plate 296 is inserted from the left side, as viewed in the drawing, between the base plate portion 234 and the projections 245 of the buckle device 220, the end of the tongue plate 296 presses the ejector 270 in the direction of arrow A in FIG. 17. When the ejector 270 is moved in the direction of arrow A in FIG. 17 against the urging force of the compression coil spring 276, the end of the tongue plate 296 is situated below the distal end of the hook 252. When the tongue plate 296 is further pressed in the direction of arrow A in FIG. 17, the distal end of the hook 252 of the lock plate 248 is situated above the opening 298 of the tongue plate 296, so that the distal end of the hook 252 is instantly rotated and enters the opening 298 since the lock plate 248 is urged in the direction of arrow D in FIG. 17. The lock plate 248 rotates, and the distal end of the hook 252 passes through the opening 298 of the tongue plate 296 and is situated in the opening 236 formed in the buckle base plate portion 234.

The lock plate 248 stops rotating as the front-side rear surface thereof, including the projections 256, is brought into contact with the bottom surfaces 242A, 242A formed in the buckle body leg plate portions 240, 240. When the lock plate 248 rotates, the release button 278 is urged by the compression coil spring 288 and reaches its leftward forward limit since the holding arms 289, 289 are disengaged from the projections 256, 256 of the lock plate 248.

In the state shown in FIG. 16, the tongue plate 296 is pressed by the ejector 270 which is urged by the compression coil spring 276, so that no rattling occurs between the tongue plate 296 and the lock plate 248.

In addition, when the occupant presses the operating portion 280 to move the release button 278 in the direction of arrow A in FIG. 16 against the urging force of the compression coil spring 288, the inclined guide portions 282, 282 of the release button 278 are pressed against the lock plate 248. The distal ends of the holding arms 289, 289 move from the upper surfaces of the projections 256, 256 of the lock plate 248 due to the movement of the release button 278, and the lock plate 248 concurrently moves upwardly along the inclined guide portions 282, 282. As a result, the lock plate 248 swings in the direction of arrow C in FIG. 16 by using as an axis the portion of the hinge 254 contacting the buckle body 222. At the same time as the lock plate 248 swings and the end of the hook 252 is released from the opening 298 of the tongue plate 296, the ejector 270 instantly moves in the direction of arrow B in FIG. 16 by being urged by the compression coil spring 276, thereby ejecting the tongue plate 296 outside the buckle device 220.

When the lock plate 248 is disengaged from the tongue plate 296 and the release button 278 is released, the release button 278 moves in the direction of arrow B in FIG. 16 by being urged by the compression coil spring 288.

Figure 19:
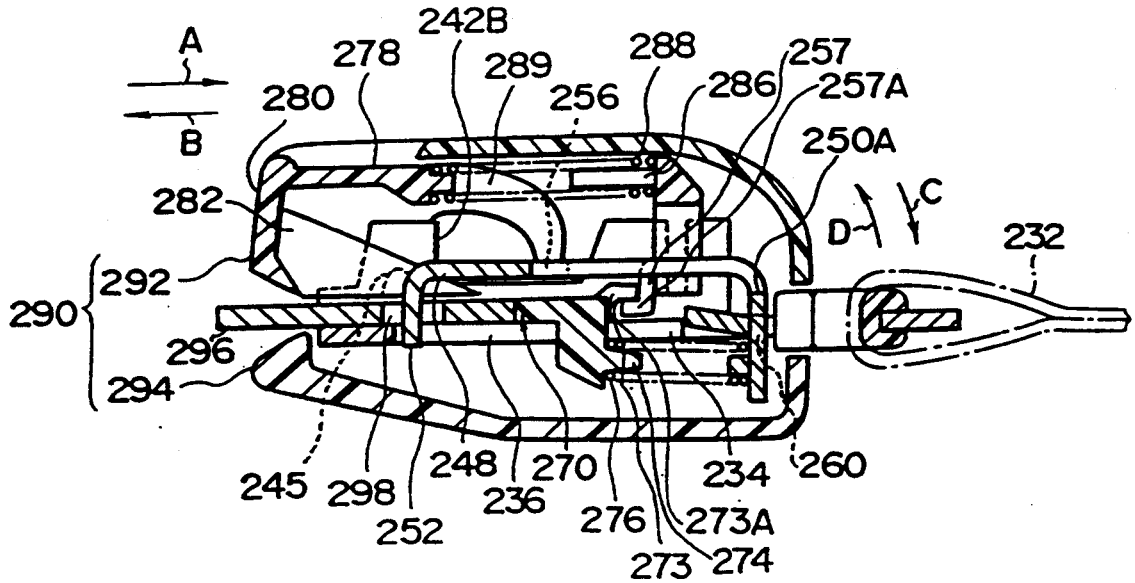
FIG. 19 is a cross-sectional view schematically illustrating a state when acceleration has acted on the buckle device in accordance with the eighth embodiment present invention.

Meanwhile, in the state in which the tongue plate 296 is engaged, as shown in FIG. 16, in the event that sudden acceleration acts in the direction of arrow A in FIG. 16, the ejector 270 moves integrally with the tongue plate 296 in the direction of arrow A in FIG. 16, so that the distal ends 273A, 273A of the hooks 273, 273 engage the hooks 257A, 257A of the lock plate 248 (the state shown in FIG. 19). Consequently, the lock plate 248 is prevented from swinging in the direction of arrow C in FIG. 16 by using as an axis the portion of the hinge 254 contacting the buckle body 222.

Accordingly, when sudden acceleration acts in the direction of arrow A in FIG. 16, it is possible to maintain the locked state of the tongue plate 296. In addition, this embodiment is superior to the first to sixth embodiments in that the arrangement for holding the locked state of the tongue plate 296 when sudden acceleration occurs is simple to make, so that productivity is better.

Figure 20:
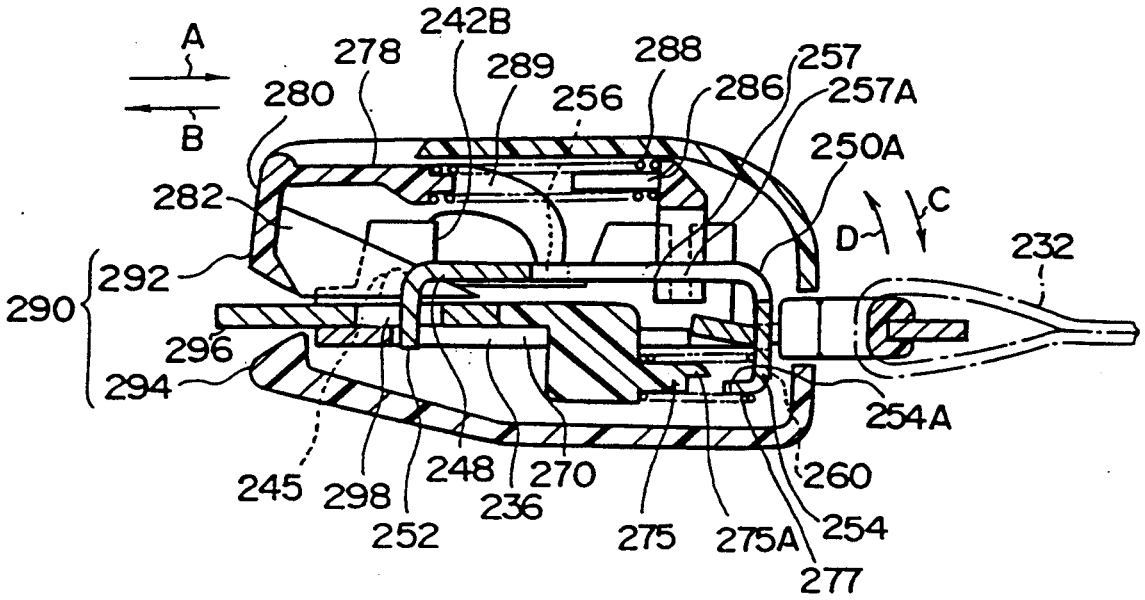
FIG. 20 is a cross-sectional view schematically illustrating a state of engagement of the tongue plate of the buckle device in another example of the eighth embodiment o present invention.
Figure 21:
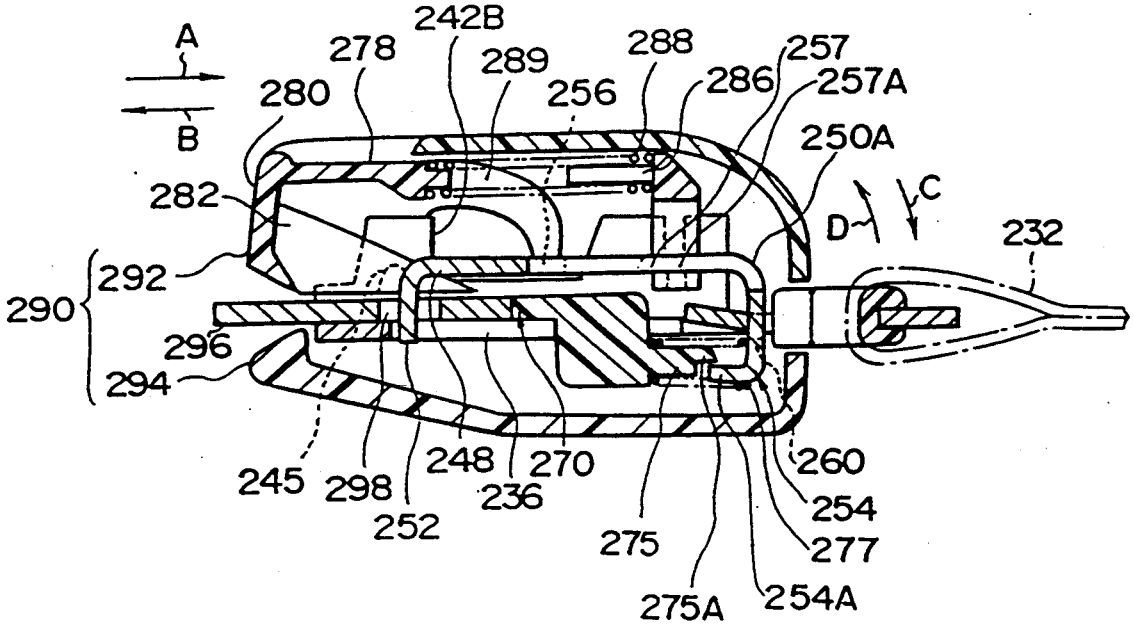
FIG. 21 is a cross-sectional view schematically illustrating a state when acceleration has acted on the buckle device in the other example of the eighth embodiment of the present invention.
Figure 22:
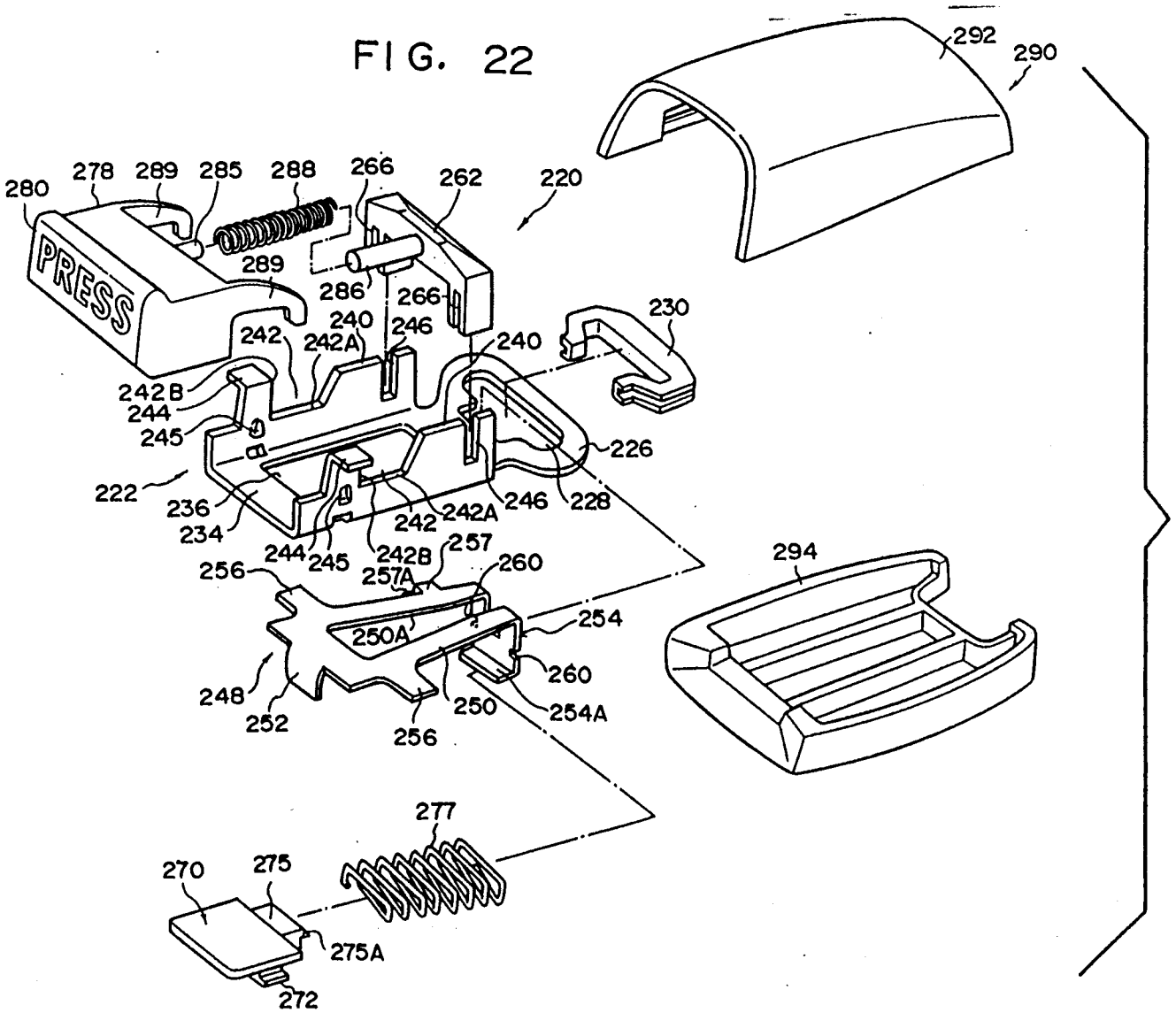
FIG. 22 is an exploded perspective view of the buckle device in the other example of the eighth embodiment of the present invention.

It should be noted that in the above-described embodiment the arrangement provided is such that the hooks 273, 273 are formed on transversely opposite ends of the ejector 270 in such a manner as to project upward. When the ejector 270 moves rightwards as viewed in FIG. 16 (in the direction of arrow A in FIG. 16), the distal ends 273A, 273A of the hooks 273, 273 engage the hooks 257A, 257A formed in the rear portions of the projections 256, 256 of the central flat-plate portion 250 of the lock plate 248 (the state shown in FIG. 19). Alternatively, it is possible to provide an arrangement in which, as shown in FIGS. 20–22, the distal end of the hinge 254 is bent toward the hook 252 side so as to form a hook 254A which also serves as a spring support for supporting one end of a compression coil spring 277. A distal end 276A of a hook 275 also serves as a support for the other end of the compression coil spring 277 and engages the hook 254A (the state shown in FIG. 21) when acceleration is effected. In this case, the structure of the ejector 270 and the lock plate 248 are further simplified.

Figure 23:
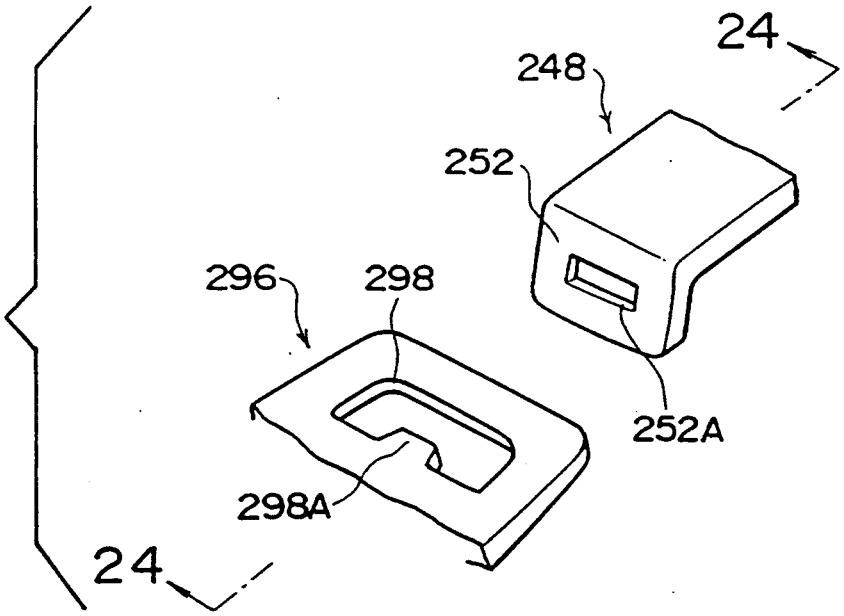
FIG. 23 is an exploded perspective view illustrating a tongue plate engaging portion of the buckle device in still another example of the eighth embodiment of the present invention.
Figure 24:
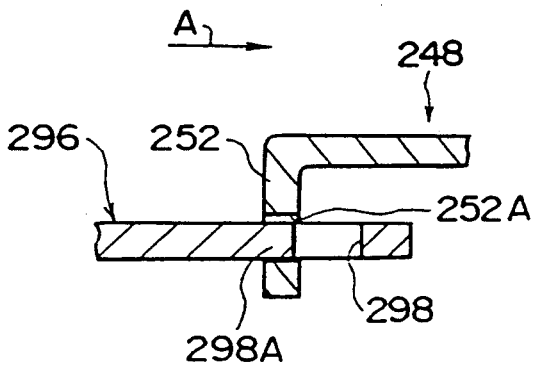
FIG. 24 is a cross-sectional view taken along the line 24—24 of FIG. 23.

It should be noted that although the ejector 270 engages the lock plate 248 in the arrangement provided in the foregoing embodiment, an arrangement may be alternatively provided such that, as shown in FIGS. 23 and 24, a projection 298A is formed on the rear end side, i.e., the left side in FIG. 24, of the opening 298 of the tongue plate 296, and when sudden acceleration acts in the rightward direction as viewed in FIG. 24 (in the direction of arrow A in FIG. 24), this projection 298A is made to engage an elongated hole 252A provided in the hook 252 of the lock plate 248.

Figure 25:
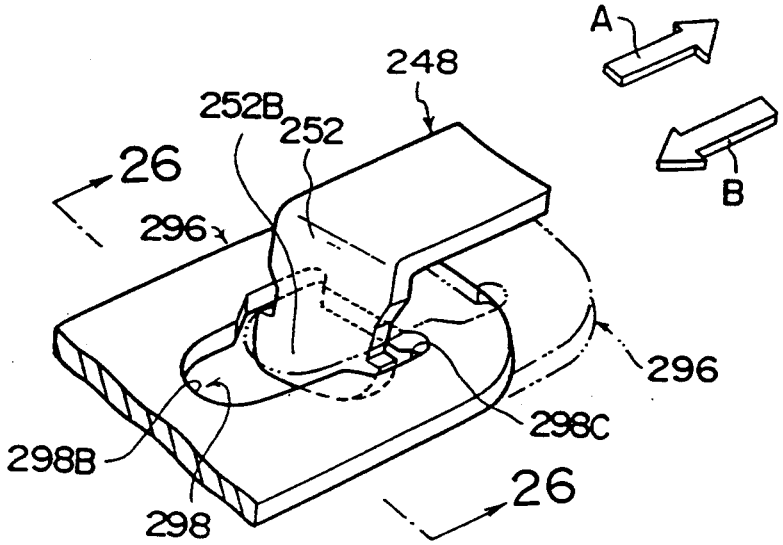
FIG. 25 is an exploded perspective view illustrating a tongue plate engaging portion of the buckle device in a further example of the eighth embodiment of the present invention.
Figure 26:
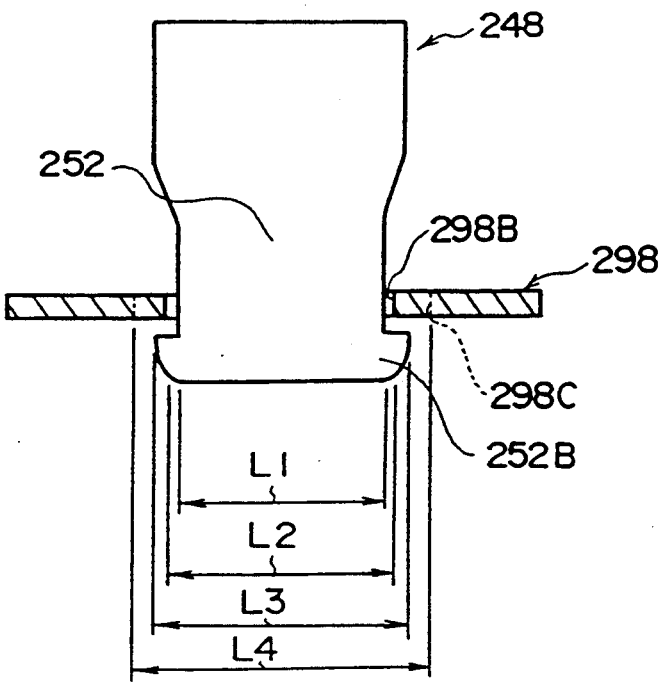
FIG. 26 is a cross-sectional view taken along the line 26—26 of FIG. 25.

In addition, as shown in FIGS. 25 and 26, the width (L2) of a rear end side 298B of the opening 298 of the tongue plate 296 is formed to be smaller than the width (L4) of a front end side 298C of the opening, and a large-width portion 252B is provided at a lower end of the hook 252 of the lock plate 248. Furthermore, the relationship between the width (L3) of this large-width portion 252B and the width (L1) of an upper portion of the hook 252 is set to be $L1<L2<L3<L4$, whereby when sudden acceleration acts in the rightward direction as viewed in FIG. 25 (in the direction of arrow A in FIG. 25), the tongue plate 296 moves in the direction of arrow A and assumes a position indicated by the two-dotted dash line. The large-width portion 252B of the lock plate 248 engages the rear end side 298B of the opening 298 of the tongue plate 296. In this case, it is possible to increase the strength of the lock plate 248.

By virtue of the above-described arrangements, the present invention offers an outstanding advantage in that it is possible to maintain the locked state of the tongue plate even when an inertial force acts on the lock canceling means in the lock canceling direction.

What is claimed is:

1. A buckle device for use in a seat belt system, comprising:

a tongue plate insertable into said buckle body;

a lock member supported by said buckle body, for engaging said inserted tongue plate and being swingable between a first position for locking said tongue plate and a second position in which engagement between said lock member and said tongue plate is released;

releasing means supported by said buckle body and being movable in a predetermined direction and adapted to swing said lock member from said first position to said second position; and emergency lock means for preventing the lock member from being released by said releasing means and thereby holding a state of engagement between said lock member and said tongue plate when an inertial force acts in said predetermined direction.

2. A buckle device according to claim 1, wherein said emergency lock means includes means for preventing the movement of said releasing means in said predetermined direction.

3. A buckle device according to claim 2, wherein said means for preventing the movement of said releasing means is supported by said releasing means and is constituted by engaging means for preventing the movement of said releasing means in said predetermined direction by engaging said buckle body when said inertial force acts in said predetermined direction.

4. A buckle device according to claim 3, wherein said engaging means includes an inertial member which is moved relative to said releasing means when said inertial force acts in said predetermined direction and a hook member engaging said buckle body by being swung by the relative movement of said inertial member.

5. A buckle device according to claim 1, wherein said emergency lock means includes an inertial member which is supported by said lock member, is swung together with said lock member, and is moved relative to said lock member when said inertial force acts in said predetermined direction, and a swinging preventing portion which is provided on said buckle body, is situated in a path of the swinging of said inertial member relatively moved, and is brought into contact with said inertial member so as to prevent the swinging of said lock member from said first position to said second position.

6. A buckle device according to claim 1, wherein said lock member is movable in said predetermined direction, and wherein said emergency lock means is constituted by a swinging preventing portion which is disposed on said buckle body and engages said lock member moved in said predetermined direction when said inertial force acts in said predetermined direction, thereby preventing the swinging of said lock member from said first position to said second position.

7. A buckle device according to claim 1, wherein said lock member is movable in said predetermined direction, and wherein said emergency lock means is constituted by a projection which is provided on said lock member and projects in a direction perpendicular to a plane of a path of the swinging of said lock member, and a swinging preventing member which is disposed on said buckle body, corresponds to said projection of said lock member moved in said predetermined direction by said inertial force acting in said predetermined direction, and is adapted to prevent the swinging of said lock member from said first position to said second position.

8. A buckle device according to claim 1, wherein said emergency lock means includes a swinging preventing member which is supported by said buckle body, which is disposed in correspondence with a forward side surface, as viewed in a swinging direction from said first position to said second position, of said lock member moved in said predetermined direction when said inertial force acts in said predetermined direction, and which is adapted to prevent the swinging of said lock member from said first position to said second position.

9. A buckle device according to claim 1, wherein said emergency lock means includes a swinging preventing member which is supported by said buckle body and is swung when said inertial force acts in said predetermined direction, said swinging preventing member being disposed in correspondence with a forward side surface, as viewed in a swinging direction from said first position to said second position, of said lock member, and adapted to prevent the swinging of said lock member from said first position to said second position.

10. A buckle device according to claim 1, further comprising an ejector for pressing said tongue plate inserted into said buckle body by means of an urging force acting in an opposite direction to the inserting direction of said tongue plate, said emergency lock means including a first projection provided on said ejector and a second projection which engages said first projection of said ejector moved in said predetermined direction when said inertial force acts in said predetermined direction, thereby preventing the swinging of said lock member from said first position to said second position.

11. A buckle device according to claim 1, wherein said tongue plate is provided with an opening into which a part of said lock member is inserted to effect engagement of said lock member therewith, and wherein said emergency lock means is interposed between said opening of said tongue plate and said part of said lock member, and said part of said lock member engages said tongue plate moved in said predetermined direction when said inertial force acts in said predetermined direction, thereby preventing the swinging of said lock member from said first position to said second position.

12. A buckle device according to claim 11, wherein said emergency lock means includes a projection projecting from a peripheral portion of said opening of said tongue plate and a hole which is provided in said part of said lock member and into which said projection is inserted.

13. A buckle device according to claim 11, wherein said emergency lock means includes a small-diameter portion provided in said opening of said tongue plate and a large-width portion which is provided in said part of said lock member and engages with a peripheral portion of said small. diameter portion.

14. A buckle device according to claim 1, wherein said predetermined direction is the direction of insertion of said tongue plate into said buckle body.

15. A buckle device for use in a vehicle seat belt system, comprising:

a buckle body;

a tongue plate insertable into said buckle body by an occupant of said vehicle;

a locked member supported by said buckle body, which is engagable with said inserted tongue plate, and is swingable between a first position for locking said tongue plate and a second position in which engagement between said lock member and said tongue plate is released;

lock assisting means which is adapted to advance from a third position for holding said lock member in said first position, by being moved in a direction substantially along a direction of insertion of said tongue plate into said buckle body, to a fourth position for enabling said lock member to swing from said first position to said second position, and which is adapted to return from said fourth position to said third position by being moved in an opposite direction thereto;

releasing means which is supported in such a manner as to be movable in a direction substantially along the direction of insertion of said tongue plate into said buckle body and which is adapted to move said lock assisting member from said third position to said fourth position and causing said lock member to swing from said first position to said second position as said tongue plate is moved by the occupant of said vehicle in said direction substantially along said direction of insertion of said tongue plate into said buckle body; and emergency lock means for preventing the lock member from being released by said releasing means and thereby preventing the swinging of said lock member from said first position to said second position when an inertial force acts in said direction substantially along said direction of insertion of said tongue plate into said buckle body.

16. A buckle device according to claim 15, wherein said emergency lock means includes means for preventing the movement of said releasing means in said direction substantially along said direction of insertion of said tongue plate into said buckle body.

17. A buckle device according to claim 16, wherein said means for preventing the movement of said releasing means is supported by said releasing means and includes an inertial member which is moved relative to said releasing means when said inertial force has acted in said direction substantially along said direction of insertion of said tongue plate into said buckle body, and a hook member engaging said buckle body by being swung by the relative movement of said inertial member.

18. A buckle device according to claim 15, wherein said emergency lock means includes an inertial member which is supported by said lock member, is swung together with said lock member, and is moved relative to said lock member when said inertial force has acted in said direction substantially along said direction of insertion of said tongue plate into said buckle body, and a swinging preventing portion which is provided on said buckle body, is situated in a path of the swinging of said inertial member relatively moved, and is brought into contact with said inertial member so as to prevent the swinging of said lock member from said first position to said second position.

19. A buckle device according to claim 15, wherein said lock member is movable in said direction substantially along said direction of insertion of said tongue plate into said buckle body, and wherein said emergency lock means is constituted by a swinging preventing portion which is interposed between said buckle body and said lock member and causes said buckle body to engage said lock member moved in said direction substantially along said direction of insertion of said tongue plate into said buckle body when said inertial force acts in said direction substantially along said direction of insertion of said tongue plate into said buckle body, thereby preventing the swinging of said lock member from said first position to said second position.

20. A buckle device according to claim 15, wherein said emergency lock means includes a swinging preventing member which is supported by said buckle body, which is moved in said direction substantially along said direction of insertion of said tongue plate into said buckle body when said inertial force has acted in said direction substantially along said direction of insertion of said tongue plate into said buckle body, and is disposed in correspondence with a forward side surface, as viewed in a swinging direction from said first position to said second position, of said lock member, and which is adapted to prevent the swinging of said lock member from said first position to said second position.

21. A buckle device according to claim 15, wherein said emergency lock means includes a swinging preventing member which is supported by said buckle body and is swung when said inertial force acts in said direction substantially along said direction of insertion of said tongue plate into said buckle body, said swinging preventing member being disposed in correspondence with a forward side surface, as viewed in a swinging direction from said first position to said second position, of said lock member, and adapted to prevent the swinging of said lock member from said first position to said second position.

22. A buckle device according to claim 15, further comprising an ejector for pressing said tongue plate inserted into said buckle body by means of an urging force acting in an opposite direction to the inserting direction of said tongue plate, said emergency lock means including a first projection provided on said ejector and a second projection which engages said first projection of said ejector moved in said direction substantially along said direction of insertion of said tongue plate into said buckle body when said inertial force has acted in said direction substantially along said direction of insertion of said tongue plate into said buckle body, thereby preventing the swinging of said lock member from said first position to said second position.

23. A buckle device according to claim 15, wherein said tongue plate is provided with an opening into which a part of said lock member is inserted to effect engagement of said lock member therewith, and wherein said emergency lock means is interposed between said opening of said tongue plate and said part of said lock member, and said part of said lock member engages said tongue plate moved in said direction substantially along said direction of insertion of said tongue plate into said buckle body when said inertial force has acted in said direction substantially along said direction of insertion of said tongue plate into said buckle body, thereby preventing the swinging of said lock member from said first position to said second position.

24. A buckle device for use in a seat belt system, comprising:

a buckle body;

a tongue plate inserted into said buckle body;

a lock member supported by said buckle body for engaging said inserted tongue plate and being swingable between a first position for locking said tongue plate and a second position in which engagement between said lock member and said tongue plate is released;

releasing means supported by said buckle body and being movable in a predetermined direction and adapted to swing said lock member from said first position to said second position; and emergency lock means including an engaging portion provided on said tongue plate and a receiving portion provided on said lock member which operatively engage each other for preventing the lock member from being released by said releasing means and thereby holding a state of engagement between said lock member and said tongue when an inertial force acts in said predetermined direction.

25. A buckle device according to claim 24, wherein said predetermined direction is the direction of insertion of said tongue plate into said buckle body.

* * * * *